US006914592B2

(12) United States Patent
Miyazawa et al.

(10) Patent No.: US 6,914,592 B2
(45) **Date of Patent: *Jul. 5, 2005**

(54) LIQUID CRYSTAL DISPLAY DEVICE HAVING A GRAY-SCALE VOLTAGE PRODUCING CIRCUIT

(75) Inventors: Toshio Miyazawa, Chiba (JP); Hideo Sato, Hitachi (JP); Hiroshi Kageyama, Hitachi (JP); Iwao Takemoto, Mobara (JP)

(73) Assignee: Hitachi, Ltd., Tokyo (JP)

( * ) Notice: Subject to any disclaimer, the term of this patent is extended or adjusted under 35 U.S.C. 154(b) by 297 days.

This patent is subject to a terminal disclaimer.

(21) Appl. No.: 10/192,695

(22) Filed: Jul. 11, 2002

(65) Prior Publication Data

US 2003/0025660 A1 Feb. 6, 2003

Related U.S. Application Data

(63) Continuation of application No. 09/421,009, filed on Oct. 29, 1999, now Pat. No. 6,433,768.

(30) Foreign Application Priority Data

Oct. 20, 1998 (JP) ..... 10-297915

(51) Int. Cl.[7] ..... G09G 3/36
(52) U.S. Cl. ..... 345/99; 345/98
(58) Field of Search ..... 345/87, 88, 89, 345/90, 92, 93, 94, 95, 98, 99, 204, 205, 690

(56) References Cited

U.S. PATENT DOCUMENTS 5,337,070 A 8/1994 Kitajima et al. ..... 345/211
5,363,118 A 11/1994 Okumura ..... 345/95
5,477,234 A * 12/1995 Suzuki et al. ..... 345/95
5,489,918 A * 2/1996 Mosier ..... 345/89
6,166,725 A 12/2000 Isami et al. ..... 345/209
6,433,768 B1 * 8/2002 Miyazawa et al. ..... 345/98
2001/0028346 A1 * 10/2001 Kudo et al. ..... 345/204

FOREIGN PATENT DOCUMENTS

EP 0458 169 A2 * 5/1990
EP 620 543 A1 10/1994
JP 5-35200 2/1993
JP 5-297828 11/1993
JP 9-106265 4/1997
JP 9-258702 10/1997
JP 9-319343 12/1997

* cited by examiner

*Primary Examiner*—Vijay Shankar
*Assistant Examiner*—Nitin Patel
(74) *Attorney, Agent, or Firm*—Antonelli, Terry, Stout & Kraus, LLP

(57) ABSTRACT

A liquid crystal display device having a plurality of pixels arranged in a matrix, a plurality of video signal lines for supplying video signal voltages to the plurality of pixels and a drive circuit for selecting a voltage level of a gray scale voltage varying periodically, as one of the video signal voltages corresponding to display data to be supplied to one of the plurality of pixels. The drive circuit has a plurality of series combinations of plural processing circuits, each of the plurality of series combinations of plural processing circuits corresponding to one of the plurality of video signal lines, each of the plural processing circuits includes a switching element which is activated by the display data and a respective one of the plurality of series combinations of the plural processing circuits determines a time to select the voltage level.

16 Claims, 21 Drawing Sheets

ODD FRAME

EVEN FRAME

LIQUID CRYSTAL DISPLAY DEVICE HAVING A GRAY-SCALE VOLTAGE PRODUCING CIRCUIT

CROSS REFERENCE TO RELATED APPLICATION

This is a continuation of U.S. application Ser. No. 09/421,009, filed Oct. 29, 1999, now U.S. Pat. No. 6,433,768, the subject matter of which is incorporated by reference herein.

BACKGROUND OF THE INVENTION

This invention relates a liquid crystal display device, and more particularly to a technique which is effectively applied to a circuit for supplying a video signal voltage to each pixel.

The active-matrix type liquid crystal display device having an active element for each pixel (for example, a thin film transistor) and switching the active elements has been used widely as a display device of a notebook personal computer.

TFT (Thin Film Transistor) type liquid crystal display module has been known as one of the active-matrix type liquid crystal display device. In a TFT type liquid crystal display module, since a video signal voltage (a gray scale voltage) is applied to a pixel electrode through a thin film transistor (TFT), the TFT type liquid crystal display module is free from crosstalk, and it is possible that the TFT type liquid crystal display module provides a multi-gray scale display without using a special driving method, unlike a simple matrix type liquid crystal display device, which requires a special driving method for preventing crosstalk between pixels.

As a method for applying a multi-gray scale video signal voltage to each pixel to render an active-matrix type liquid crystal display device capable of the multi-gray scale display, a method described in Japanese Published Unexamined Patent Application No. Hei 5-35200 (published on Feb. 12, 1999) (corresponding to U.S. Pat. No. 5,337,070, issued on Aug. 9, 1994) has been known.

Japanese Published Unexamined Patent Application No. Hei 5-35200 discloses a method in which $2^m$ voltage bus lines are provided, and gray scale voltages provided from the $2^m$ voltage bus lines vary in a staircase fashion having $2^k$ steps during one horizontal scanning period corresponding to one horizontal scanning line.

One of the above-mentioned $2^m$ voltage bus lines is selected based on the high-order m bits of an n-bit display data, one of the voltage levels is selected from the gray scale voltage varying in a staircase fashion on the selected voltage bus line based on the lower-order k (k=n−m) bits of the n-bit display data, and the selected voltage level is applied to a pixel electrode of each pixel.

For example, a case in which the display data is 3 bits (n=3), m=1, and k=2 is assumed. Two voltage bus lines are provided and each voltage bus line is supplied with a gray scale voltage varying in a staircase fashion having four steps during one horizontal scanning period such that eight voltage levels of the two gray scale voltages are different from each other.

A gray scale voltage carried on one of two voltage bus lines is selected based on the high-order 1 bit of the 3-bit display data, one voltage level is selected from the gray scale voltage varying in a staircase fashion having four steps on the selected voltage bus line, based on the lower-order 2 bits of the 3-bit display data, and the selected voltage level is applied to the pixel electrode of each pixel.

According to the driving method described in the above-mentioned publication, the operating speed of the circuit for applying a video signal voltage on each pixel can be reduced, and the number of voltage bus lines can be reduced.

Recently, the liquid crystal display device has been increased in the number of steps of the gray scales to 64 or 256.

In the case where gray scales of 64 or 256 steps is realized by the method described in Japanese Published Unexamined Patent Application No. Hei 5-35200, the circuit scale of a selector circuit for selecting voltage levels varying in a staircase fashion having $2^k$ steps on the selected voltage bus lines should be large. In the case where the selector circuit is incorporated into a liquid crystal display panel, an area occupied by the selector circuit should be large, and the liquid crystal display panel should be consequently large. The large size is disadvantageous for the liquid crystal display panel.

SUMMARY OF THE INVENTION

The present invention solves the problem of the above-mentioned prior art, and it is the object of the present invention to provide a technique for rendering the circuit scale of the driving means for horizontal scanning of a liquid crystal display device small.

The above-mentioned object and novel features of the present invention will be obvious with reference to the description of the specification and the accompanying drawings.

In accordance with one embodiment of the present invention, there is a liquid crystal display device comprising: a plurality of pixels arranged in a matrix, a plurality of video signal lines for supplying video signal voltages to the plurality of pixels, and a drive circuit for selecting a voltage level of a gray scale voltage varying periodically, as one of the video signal voltages corresponding to display data to be supplied to one of the plurality of pixels, wherein the drive circuit has a plurality of series combinations of plural processing circuits, each of the plurality of series combinations of plural processing circuits corresponding to one of the plurality of video signal lines, each of the plural processing circuits includes a switching element which is activated by the display data, and a respective one of the plurality of series combinations of the plural processing circuits determines a time to select the voltage level by a combination of statuses of the switching elements in the respective one of the plurality of series combinations of plural processing circuits.

In accordance with another embodiment of the present invention, there is provided a liquid crystal display device comprising: a plurality of pixels arranged in a matrix, a plurality of video signal lines for supplying video signal voltages of the plurality of pixels, and a drive circuit for selecting one voltage level of a gray scale voltage varying with a horizontal scanning period, as one of the video signal voltages according to display data for one of the plurality of pixels, wherein the drive circuit has a plurality of series combinations of plural processing circuits for performing a logic operation in order to select the one voltage level of the gray scale voltage, each of the plurality of series combinations of plural processing circuits corresponding to one of the plurality of video signal lines, each of the plural processing circuits in a respective one of the plurality of series combinations of plural processing circuits is supplied with the display data, and each of the plurality of series combinations of plural processing circuits is configured such that a respective one of the processing circuits transmits a processing result based upon the display data to one of the processing circuits succeeding the respective one.

In accordance with another embodiment of the present invention, there is provided a liquid crystal display device comprising: a plurality of pixels arranged in a matrix, a plurality of video signal lines for supplying video signal voltages to the pixels respectively, and a drive circuit for selecting a voltage level of gray scale voltages varying periodically as one of the video signal voltages corresponding to display data to be supplied to one of the pixels, wherein the drive circuit has a plurality of processing circuits being connected to each other in series for determining a time to select the voltage level, each of the processing circuits including a switching element which is activated by the display data so that the processing circuits determine the time by combination of status of the switching element in each of the processing circuits.

In accordance with another embodiment of the present invention, there is provided a liquid crystal display device comprising: a plurality of pixels arranged in a matrix, a plurality of video signal lines for supplying video signal voltages to the plurality of pixels respectively, a drive circuit selecting one of gray scale voltages varying with a horizontal scanning period as one of the video signal voltages according to display data for one of the pixels, wherein the drive circuit has a plurality of processing circuits for performing logic operation in order to select the one of gray scale voltage, each of the processing circuits connecting in series so that one of the processing circuits transmits processing result to the next one of processing circuits.

BRIEF DESCRIPTION OF THE DRAWINGS

In the accompanying drawings, in which like reference numerals designate similar components throughout the figures, and in which:

FIGS. 21A and 21B are diagrams for explaining the polarity of the gray scale voltages supplied to the drain signal line (D) in the case where dot-inversion drive method is used as a driving method of a liquid crystal display module, wherein FIG. 21A is for an odd frame and FIG. 21B is for an even frame.

DETAILED DESCRIPTION OF THE PREFERRED EMBODIMENTS

Figure 1:
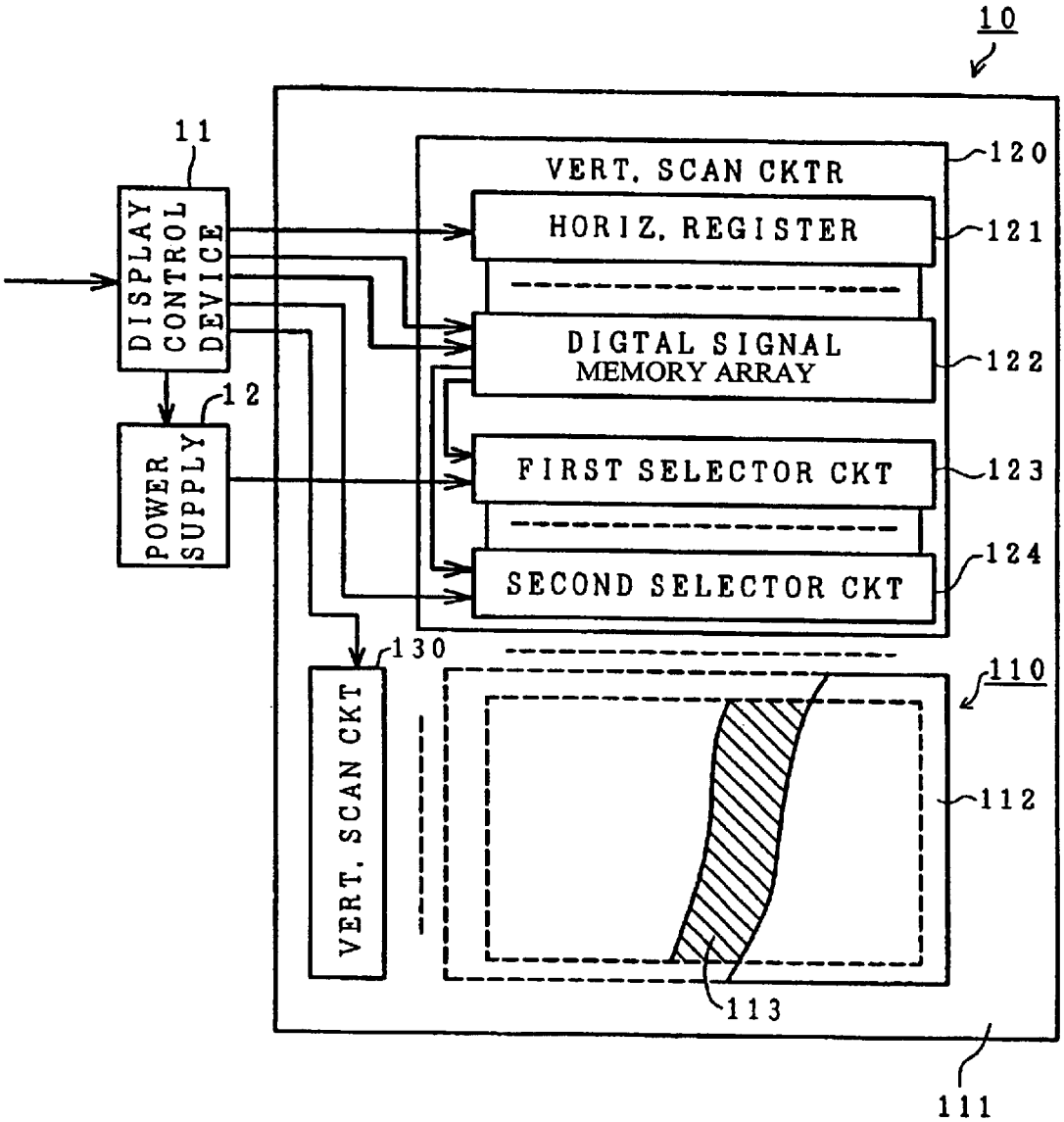
FIG. 1 is a block diagram for illustrating a schematic structure of a whole TFT type liquid crystal display module of a first embodiment of the present invention.

Preferred embodiments of the present invention will be described in detail hereinafter with reference to the drawings.

In all the drawings for describing embodiments of the present invention, components having the same function are given the same reference numerals or reference characters and their repeated description is omitted.

First Embodiment

FIG. 1 is a block diagram for illustrating the whole schematic structure of a TFT type liquid crystal display module of a first embodiment of the present invention.

The liquid crystal display module of the present embodiment comprises a liquid crystal display panel (a liquid crystal display element of the present invention) 10, a display control device 11, and a power supply 12.

The liquid crystal display panel 10 comprises a display section 110, a vertical pixel-line selector circuit (hereinafter referred to as a horizontal scanning circuit) 120, and a horizontal pixel-line selector circuit (hereinafter referred to as a vertical scanning circuit) 130.

The horizontal scanning circuit 120 comprises a memory address selector circuit (hereinafter referred to as a horizontal shift register) 121, a digital signal memory array 122, a first selector circuit (a higher-order bit selector circuit) 123, and a second selector circuit (a lower-bit selector circuit) 124.

Figure 2:
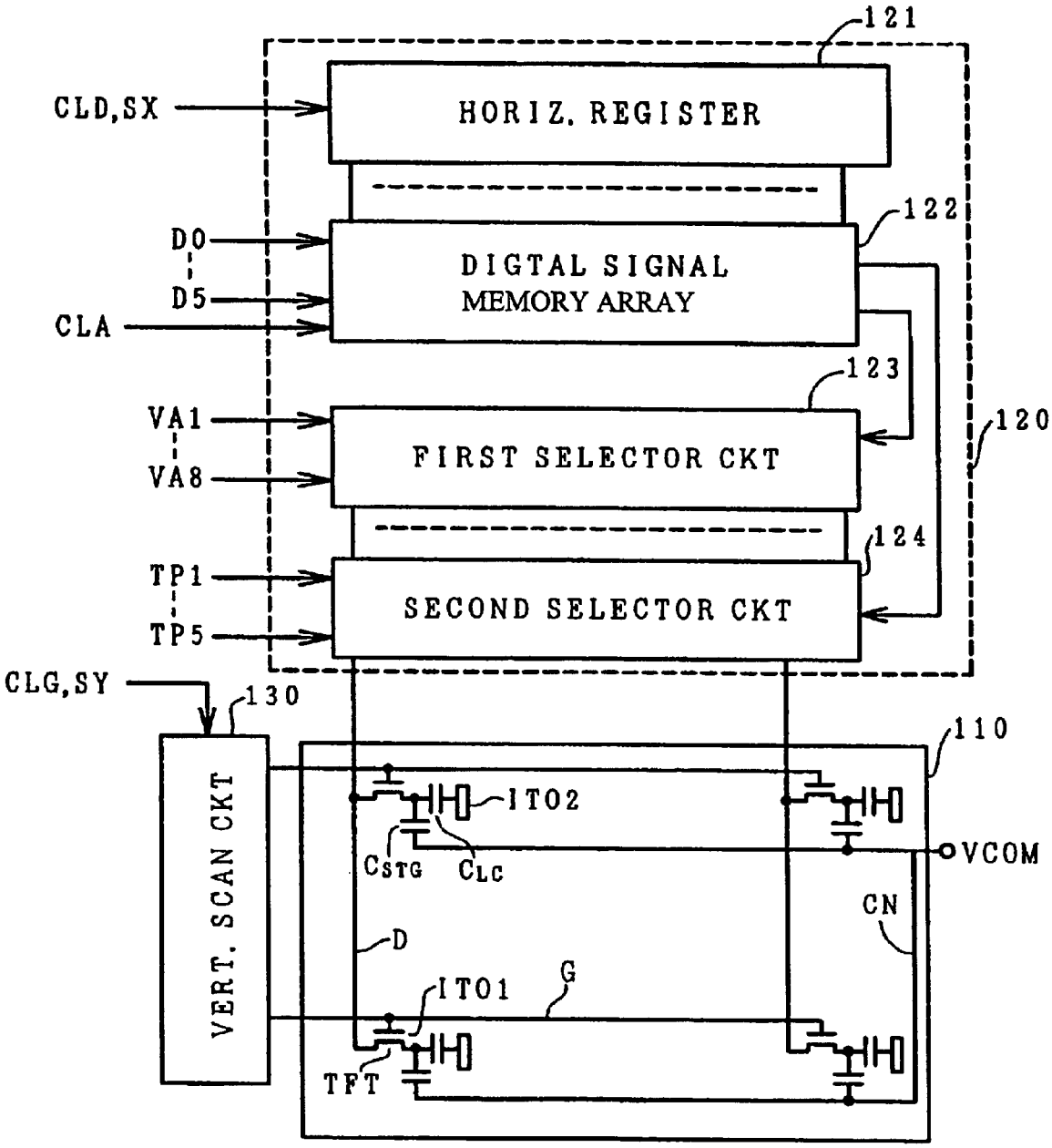
FIG. 2 is a circuit diagram for illustrating an equivalent circuit of an exemplary liquid crystal display panel of the first embodiment of the present invention.

FIG. 2 is a circuit diagram for illustrating an exemplary equivalent circuit of the liquid crystal display panel 10 of the present embodiment.

FIG. 2 also indicates the signals supplied to the horizontal scanning circuit 120 and to the vertical scanning circuit 130 from the display control device 11, and the gray scale voltages supplied to the horizontal scanning circuit 120 from the power supply 12.

A display section 110 of this embodiment comprises a pair of opposing substrates 111, 112, at least one of which is transparent, a liquid crystal layer 113 sandwiched between the pair of opposing substrates, and a plurality of pixels arranged in a matrix. Each pixel is disposed in a region enclosed by two adjacent gate signal lines (scanning signal lines or horizontal signal lines) (G) and two adjacent drain signal lines (video signal lines or vertical signal lines) (D).

Each pixel has a thin film transistor (TFT) comprising, for example, a poly-Si transistor (hereinafter referred to as a poly-Si Tr), drain regions of thin film transistors (TFTs) of the pixels on each column of the pixel matrix are electrically connected to one of the drain signal lines (D), and respective source regions of the thin film transistors (TFTs) of the pixels are electrically connected to one of the pixel electrodes (ITO1).

Although the roles of the drain region and the source region are interchanged depending upon the polarity of a bias voltage applied between the drain region and the source region, and in this embodiment the polarity of the bias voltage applied between the drain region and the source region is inverted during operation and the roles of the drain region and the source region are interchanged during the operation, in the specification of the present invention, a particular one and the other are always considered fixedly as the drain region and the source region, respectively, for the purpose of convenience.

The gate electrodes of the thin film transistors (TFTs) of the pixels on each row of the pixel matrix are electrically connected to one of the gate signal lines (G), and each thin film transistor (TFT) becomes conductive when a positive bias voltage is applied to the gate electrode and becomes noncoductive when a negative bias voltage is applied to the gate electrode.

A liquid crystal layer is sandwiched between the pixel electrode (ITO1) and the common electrode (the counter electrode)(ITO2) and consequently a liquid-crystal electric capacitance (CLC) is formed between the pixel electrode (ITO1) and the common electrode (ITO2).

A holding capacitance (CSTG) is formed between the source region of the thin film transistor (TFT) and the common signal line (CN), and the common signal line (CN) is supplied with a driving voltage (VCOM) applied to the common electrode (ITO2). FIG. 2 is a circuit diagram and the diagram is drawn correspondingly to the actual geometrical location. Drain regions of thin film transistors (TFTs) of the pixels on each column of the pixel matrix are electrically connected to one of the video signal lines (D) and the video signal lines (D) are connected to the second selector circuit 124.

Gate electrodes of the thin film transistors (TFTs) of the pixels on each row of the pixel matrix are electrically connected to one of the gate signal lines (G) and the gate signal lines (G) are connected to the vertical scanning circuit 130.

The display control device 11 comprises one large-scale semiconductor integrated circuit (LSI), controls and drives the horizontal scanning circuit 120 and the vertical scanning circuit 130 based on respective display control signals such as a clock signal, a display timing signal, a horizontal sync signal, and a vertical sync signal and display data (R, G, and B) transmitted from, the host computer.

The power supply 12 shown in FIG. 1 supplies gray scale voltages (VA1 to VA8) to the horizontal scanning circuit 120, supplies drive voltages (a positive bias voltage and a negative bias voltage) which are to be applied to the gate electrode of the thin film transistor (TFT) to the vertical scanning circuit 130, and supplies a drive voltage (VCOM) to the common electrode (ITO2).

Next, the operation of the liquid crystal display module for the case of 6-bit display data in the present embodiment will be described schematically hereunder. Upon receiving the first display timing signal after an input of a vertical sync signal, the display control device 11 judges it to be the fist display line and sends out a start pulse (SY) to the vertical scanning circuit 130.

Furthermore the display control device 11 outputs shift clocks (CLG) having a period equal to one horizontal scanning period to the vertical scanning circuit 130 so as to apply positive bias voltages to respective gate signal lines (G) of the liquid crystal display panel 10 in succession with a horizontal scanning period based on the horizontal sync signal.

As a result, the vertical scanning circuit 130 selects gate signal lines (G) in succession, outputs positive bias voltages to the selected gate signal line (G), and turns on the thin film transistors (TFT) having the gate electrode to which the selected gate signal line (G) is connected during one horizontal scanning period.

Upon receiving the display timing signal, the display control device 11 judges it to be a display start position, and outputs the received one row of 6-bit display data to the digital signal memory array 122 of the horizontal scanning circuit 120.

Simultaneously, the display control device 11 outputs a start pulse (SX) and a splay data latch clock (CLD) to the horizontal shift register circuit 121 of the horizontal scanning circuit 120.

As a result, the horizontal sift register 121 outputs display data input shift pulses (SH) to the digital signal memory array 122 in succession.

The digital signal memory array 122 stores the display data in succession based on the display data input shift pulse (SH), and outputs the higher-order bits of the display data to the first selector circuit 123 and outputs the lower-order bits of the display data to the second selector circuit 124.

Plural gray scale voltages (8 in FIG. 2) have been entered in the first selector circuit 123, the first selector circuit 123 selects one of these plural gray scale voltages based on the higher-order bits of the display data, and outputs to the second selector circuit 124.

The plural gray scale voltages vary in a staircase fashion during one horizontal scanning period.

The second selector circuit 124 selects a voltage level of the gray scale voltage selected by the first selector circuit 123 at a time determined by the lower order bits of the display data and outputs it to the drain signal line (D).

Then the gray scale voltage levels corresponding to the display data are written into pixels associated with thin film transistors (TFT), and the gate electrodes of which are connected to the selected gate signal line (G), and an image is formed in the display section 10.

The horizontal scanning circuit 120 and the vertical scanning circuit 130 shown in FIG. 1 are incorporated into the liquid crystal display panel 10, which are formed of poly-Si Tr like the thin film transistors (TFT) and are formed on the same substrate as the thin film transistors are.

Figure 3:
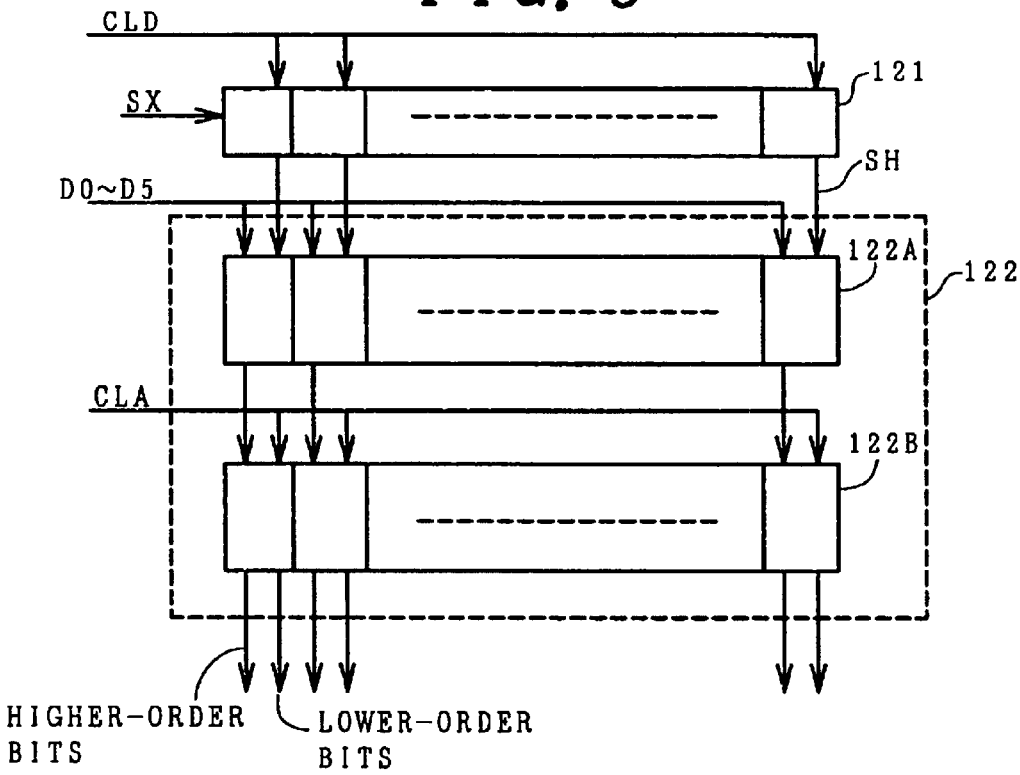
FIG. 3 is a circuit diagram for illustrating a circuit structure of a digital signal memory array shown in FIGS. 1 and 2.

FIG. 3 is a circuit diagram for illustrating the circuit structure of the digital signal memory array 122 shown in FIGS. 1 and 2. As shown in FIG. 3, the digital signal memory array 122 is provided with the first latch circuit 122A and second latch circuit 122B, and the first latch circuit 122A latches the display data from the display control device 11 in succession based on display data input shift pulses (SH) from the horizontal shift register 121.

The second latch circuit 122B latches the display data taken into the first latch circuit 122A based on an output timing control clock (CLA) from the display control device 11, and outputs the higher-order 3-bits of the display data to the first selector circuit 123 and the lower-order 3-bits to the second selector circuit 124.

Figure 4:
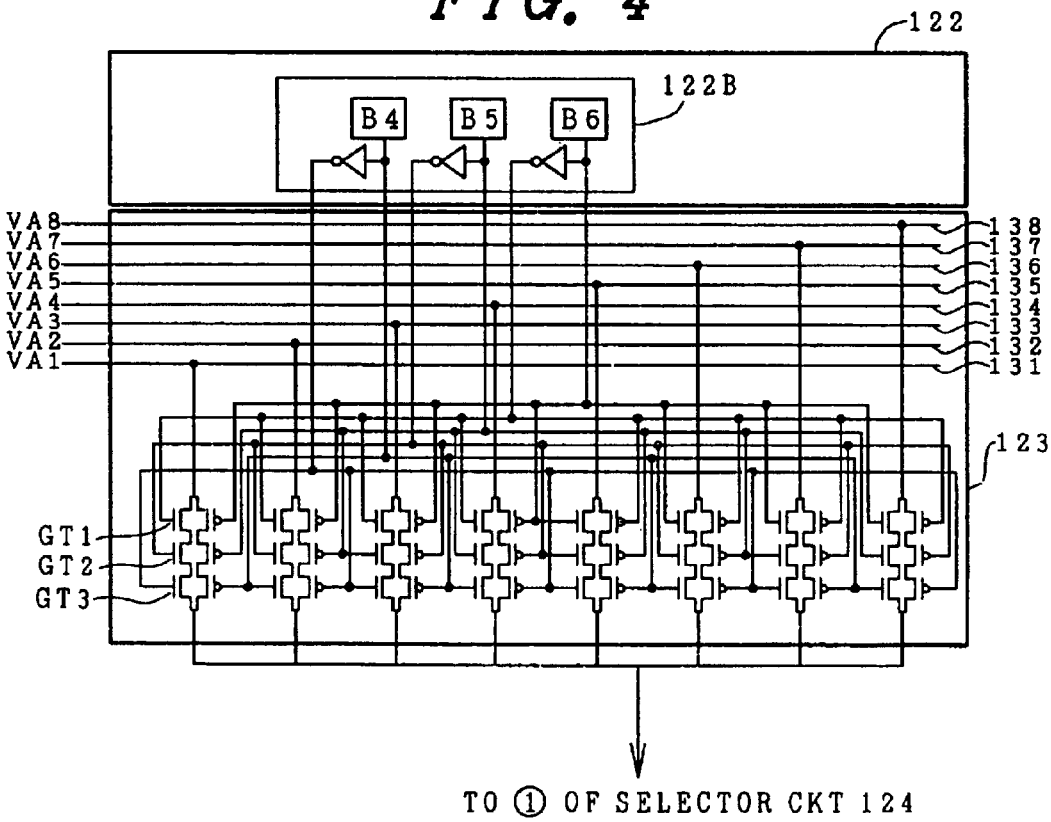
FIG. 4 is a circuit diagram for illustrating a circuit structure of a selector associated with each drain signal line (D) in the first selector circuit shown in FIGS. 1 and 2.

FIG. 4 is a circuit diagram for illustrating the circuit structure of a selector associated with each drain signal line (D) in the first selector circuit 123 shown in FIGS. 1 and 2.

In FIG. 4, B6 represents the 6th bit of the display data, B5 represents the 5th bit of the display data, and B4 represents the 4th bit of the display data.

As shown in FIG. 4, a selector associated with each drain signal line (D) in the first selector circuit 123 has 8 groups each including first, second and third gate circuits (GT1 to GT3) each formed of a p-type MOS transistor (hereinafter referred simply as to a PMOS) and an n-type MOS transistor (hereinafter referred simply to as an NMOS).

A noninverted output or inverted output of the 6th bit (B6) of the display data is applied to the gate electrodes of the PMOS and NMOS of the first gate circuit (GT1), a noninverted output or inverted output of the 5th bit (B5) of the display data is applied to the gate electrodes of the PMOS and NMOS of the second gate circuit (GT2), and a noninverted output or inverted output of the 4th bit (B4) of the display data is applied to the gate electrodes of the PMOS and NMOS of the third gate circuit (GT3).

A combination of a noninverted output or an inverted output of respective bits applied to gate electrodes of the PMOS and NMOS of the first to third gate circuits (GT1 to GT3) is changed to thereby select a gray scale voltage on one of the eight voltage bus lines 131 to 138, and outputs the selected gray voltage to the second selector circuit 124.

Figure 5:
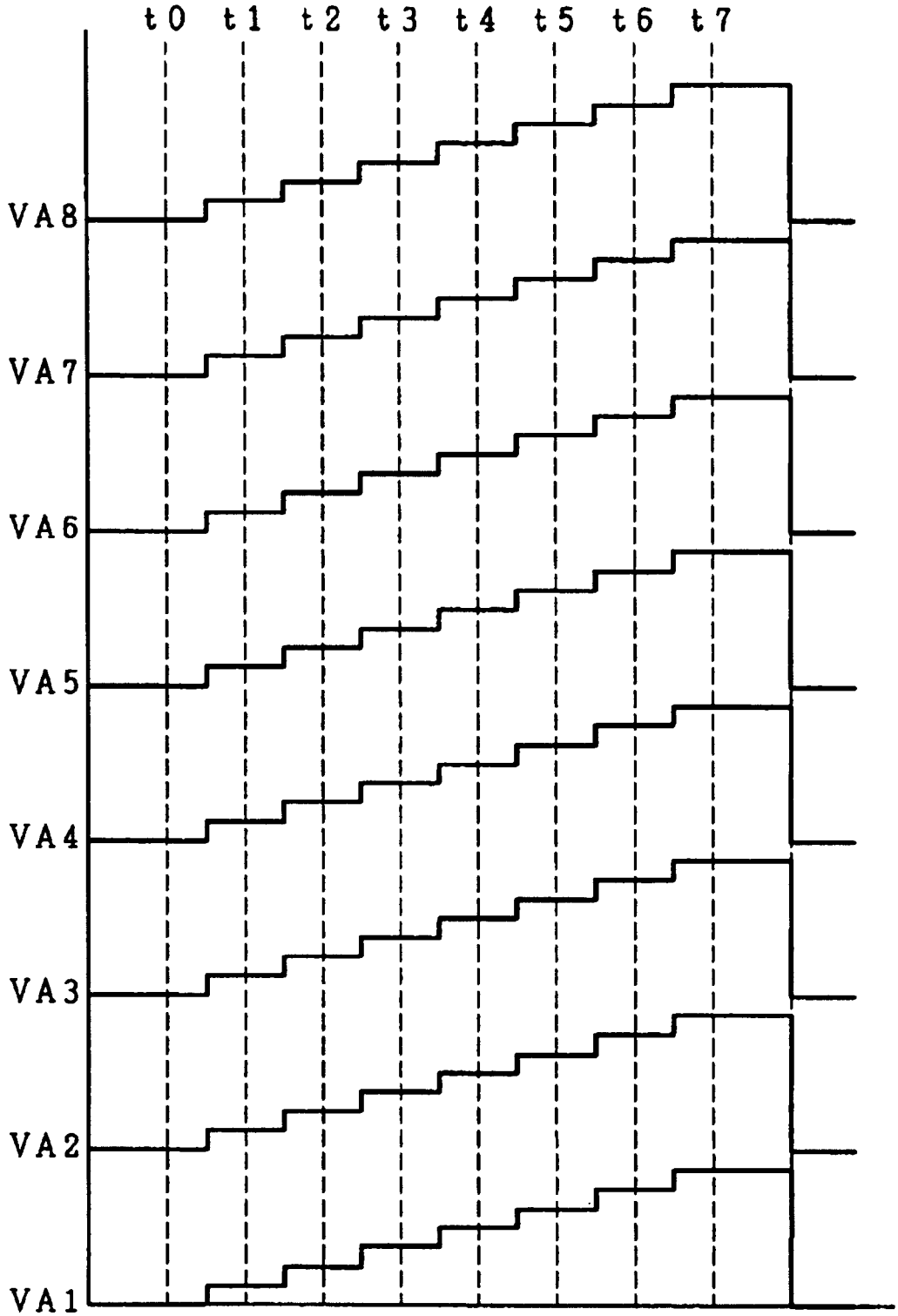
FIG. 5 is a waveform diagram for illustrating a voltage level variation during one horizontal scanning period of gray scale voltages (VA1 to VA8) supplied to each voltage bus line shown in FIG. 4.

The gray scale voltages VA1 to VA8 carried on the voltage bus lines 131 to 138, respectively, vary in a staircase fashion of eight levels during one horizontal scanning period, the 64 voltage levels being different from each other as shown in FIG. 5.

Figure 6:
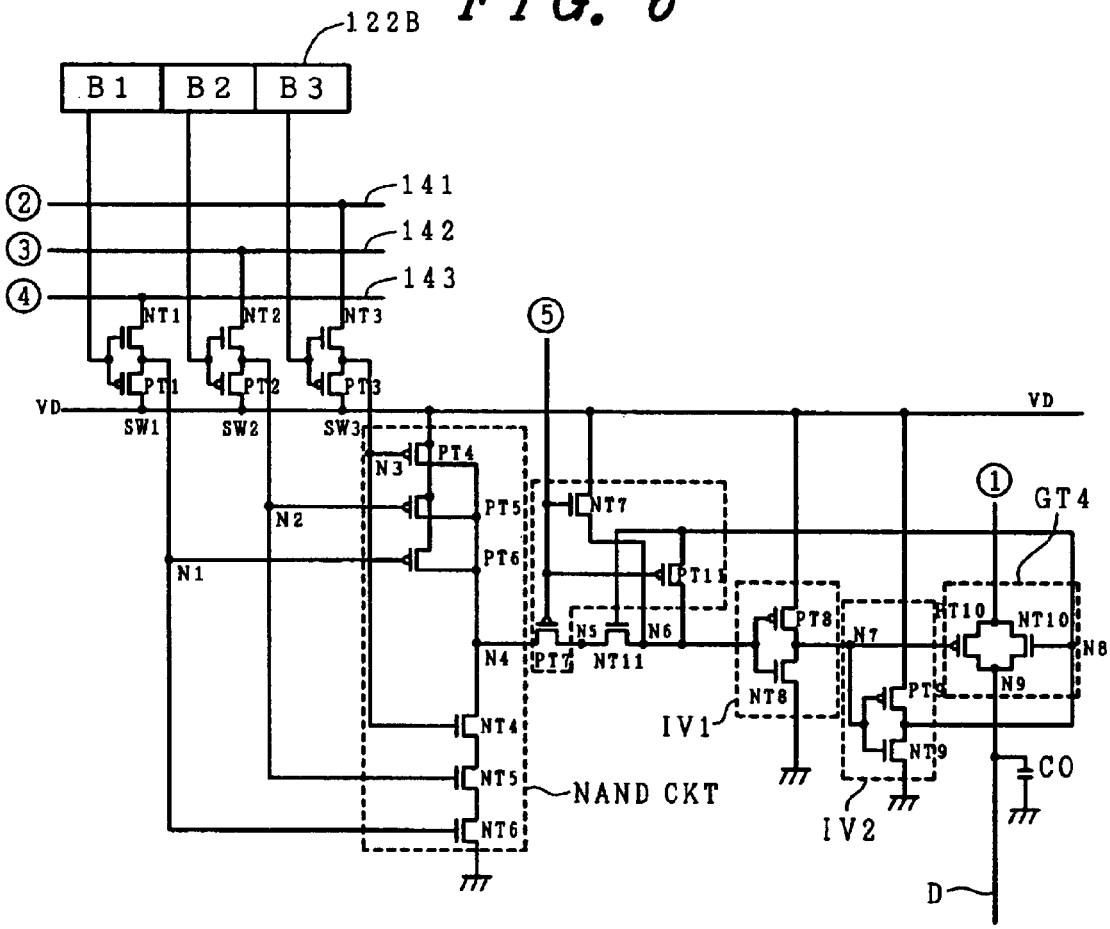
FIG. 6 is a circuit diagram for illustrating a circuit structure of a selector associated with each drain signal line (D) in a second selector circuit shown in FIGS. 1 and 2.

FIG. 6 is a circuit diagram for illustrating the circuit structure of a selector associated with each drain signal line (D) in the second selector circuit 124 shown in FIGS. 1 and 2.

Figure 7:
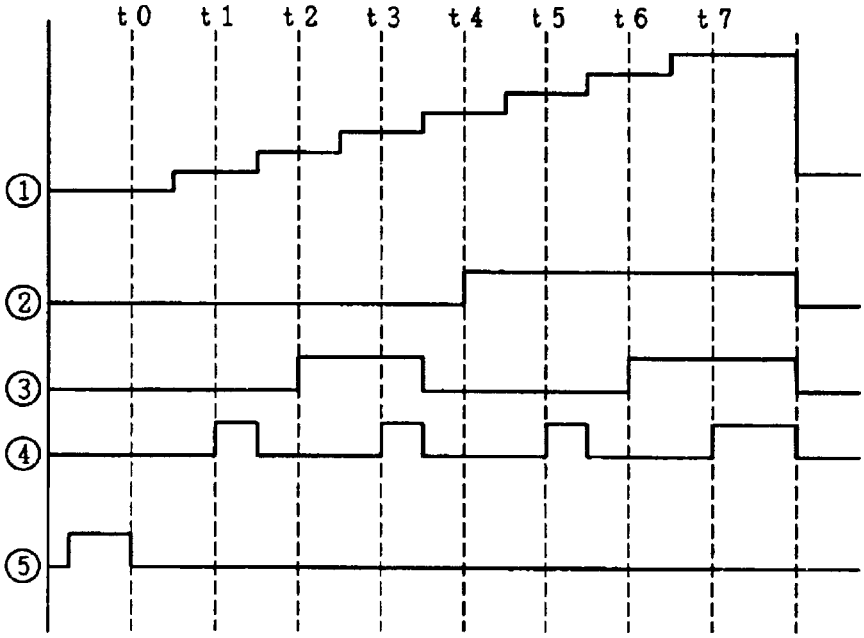
FIG. 7 is a waveform diagram for illustrating the waveform of time control pulses (②, ③, and ④) shown in FIG.6.

In FIG. 6, B3 represents the 3rd bit of the display data, B2 represents the 2nd bit of the display data, and B1 represents the 1st bit of the display data, and reference numerals 141, 142 and 143 represent the time control signal lines supplied with time control pulses having waveforms such as ②, ③ and ④ shown in FIG. 7, for example.

In FIG. 7, ② represents the time control pulse for the 3rd bit (B3) of the display data, ③ represents the time control pulse for the 2nd bit (B2) of the display data, and ④ represents the time control pulse for the 1st bit (B1) of the display data.

These time control pulses comprise alternate pulses of an High voltage level (hereinafter referred to simply as an H level) and a Low voltage level (hereinafter referred to simply as an L level), and assuming that the period of time control pulse ④ of the 1st bit (B1) of the display data is k, then the period of the time control pulse ③ for the 2nd bit (B2) of the display data is 2k and the period of the time control pulse ② for the 3rd bit (B3) of the display data is 4k (2×2×k).

The time control pulses ② to ④ rise near the center of the respective voltage levels of the gray scale voltages VA1 to VA8 of FIG. 5 represented by ① at time $t_n$ as shown in FIG. 7.

The reason is that the gray scale voltage to be applied to the drain signal line (D) is reliably determined in view of the time required for, voltage change of the time control pulses because the gray voltage to be applied to the drain signal line (D) is determined at the rising edge of the time control pulses.

In FIG. 6, the switching circuit (SW1) of the CMOS structure comprising the PMOS (PT1) and NMOS (NT1) and the noninverted 1st bit output of the display data is supplied to respective gate electrodes of the PMOS (PT1) and NMOS (NT1). The switching circuit (SW1) outputs the time control pulse ④ when the 1st bit of the display data is an H level, and the switching circuit (SW1) outputs a VD (an H level) when the 1st bit of the display data is an L level.

Similarly, the switching circuit (SW2) of the CMOS structure comprising the PMOS (PT2) and NMOS (NT2) outputs the time control pulse ③ when the 2nd bit of the display data is an H level, and it outputs a VD (an H level) when the 2nd bit of the display data is an L level.

Furthermore, the switching circuit (SW3) of the CMOS structure comprising the PMOS (PT3) and NMOS (NT3) outputs the time control pulse ② when the 3rd bit of the display data is an H level, it outputs a VD (an H level) when the 3rd bit of the display data is an L level.

The PMOS (PT4 to PT6) and NMOS (NT4 to NT6) constitute a three-input NAND circuit for receiving the output of the respective switching circuits (SW1 to SW3), and the three-input NAND circuit holds the output node at an H level unless all the signals supplied to the respective input nodes (N1, N2, and N3) are at an H level.

PMOS (PT7), NMOS (NT7), and PMOS (PT11) are switching transistors having respective gate electrodes supplied with a reset pulse ⑤ shown in FIG. 7.

When the reset pulse ⑤ is an H level, the PMOS (PT7) is turned OFF and the electric connection between the node (N4) and node (N5) is disconnected, and at the same time PMOS (PT11) is turned OFF, and the electric connection between the node (N6) and node (N8) is disconnected. As a result, the connection of the node (N6) to all other nodes in the circuit is disconnected. Further the NMOS (NT7) is turned ON, and therefore the node (N6) is connected to the power supply potential (VD) and the node (N6) is brought into the initial state.

When the reset pulse ⑤ is an L level, the PMOS (PT7) and PNOS (PT11) are turned ON and the NMOS (NT7) is turned OFF and the node (N4) is connected to the node (N5) and the node (N6) is connected to the node (N8), and the node (N6) is disconnected from the power supply potential (VD).

The PMOS (PT8) and NMOS (NT8) constitute an inverter circuit (IV1) which receives the output (a potential at the nodes (N4), (N5) and (N6)) of the NAND circuit when the PMOS (PT7) and NMOS (NT11) are ON.

The PMOS (PT9) and NMOS (NT9) constitute an inverter circuit (IV2) which receives the output of the inverter circuit (IV1).

The output of the inverter circuit (IV2) is supplied to the inverter circuit (IV1) when the PNOS (PT11) is ON. Accordingly, when the NMOS (NT7) or NMOS (NT11) is OFF and the input of the inverter circuit (IV1) is electrically disconnected from the output of the NAND circuit, these two inverter circuits (IV1 and IV2) forms a latch circuit to maintain the state of the inverter circuit (IV1 and IV2).

The PMOS (PT11) takes on only the role to compensate for the potential change of the node (N6) due to dark current or leakage current with the output of the inverter circuit (IV2) when the inverter circuit (IV1) is disconnected electrically from the output of the NAND circuit, and the PMOS (PT11) needs to be a transistor having a substantially large ON resistance.

The resistance of the PMOS (PT11) should be high so that an H level potential (a potential at the node (N8)) of the inverter circuit. (IV2) which is supplied through the PMOS (PT11) does not affect the L level output of the NAND circuit, the output of the inverter (IV1) is inverted, and the potential of the node (N7) is turned from an L level to an H level when the output of the NAND circuit is turned from an H level to an L level.

To ensure the operation, a high resistance may be inserted between the PMOS (PT11) and the node (N6).

The NMOS (NT11) is a switching transistor with a gate electrode supplied with the output of the inverter circuit (IV2), and is ON when the node (N6) is an H level and is OFF when the node (N6) is an L level.

In other words, once the node (N8) becomes an L level, the electric connection between the node (N5) and node (N6) is disconnected until it is reset into an initial state by the reset pulse ⑤.

The node (N8) is electrically connected to the node (N6) through the PMOS (PT11). The PMOS (PT11) functions as a resistance component to the H level potential of the node (N8) when the potential of the node (N6) is turned from the H level to the L level, and stabilizes the L level state.

The PMOS (PT10) and NMOS (NT10) constitute a gate circuit (GT4), and the output of the inverter circuit (IV1) is applied to the gate electrode of PMOS (PT10) and the output of the inverter circuit (IV2) is applied to the gate electrode of NMOS (NT11).

When the output of the inverter circuit (IV1) is an L level and the output of the inverter circuit (IV2) is an H level, the gate circuit (GT4) is turned on, and a gray scale voltage selected by the first selector circuit 123 is supplied to the drain signal line (D).

On the other hand, when the output of the inverter circuit (IV1) is an H level and the output of the inverter circuit (IV2) is an L level, the gate circuit (GT4) is turned off, and the gray scale voltage selected by the first selector circuit 123 is disconnected from the drain signal line (D).

Once the gate circuit (GT4) is turned off, the OFF state remains until the subsequent pulse ⑤ becomes an H level, a gray scale voltage written into each pixel is a voltage level of a time-varying gray scale voltage selected by the first selector circuit 123 at the time when the gate circuit GT4 is turned off.

The reference character C0 is a capacitance element for maintaining the potential of the drain signal line (D), and the capacitance formed by the MOS transistor or the capacitance formed by wiring may be used as the capacitance element (C0).

The operation of the second selector circuit 124 is described exemplarily for the case where the lower-order 3 bits of the display data are (1, 0, 1).

In the case where the lower-order 3 bits of the display data are (1, 0, 1), the switching circuit (SW1) outputs the time control pulse ④, the switching circuit (SW2) outputs the VD potential, and the switching circuit (SW3) outputs the time control pulse ②.

Before time t0, the reset pulse ⑤ is turned to the H level, and the node (N6) is turned to the initial state, namely, the H level.

At this time, the output of the inverter circuit (IV1) is turned from the H level to the L level, and the output of the inverter circuit (IV2) is turned from the L level to the H level.

The H level of the reset pulse ⑤ needs to have such sufficient time that the above-explained operations are reliably performed.

When the initial state is over, the NMOS (NT11) is turned on, the node (N5) and the node (N6) are connected electrically to each other, the gate circuit (GT4) is simultaneously turned on, and the gray scale voltage selected by the first selector circuit 123 is supplied to the drain signal line (D).

Accordingly the potential of the drain signal line (D) is turned to the potential of the voltage level at the time t0 of the gray scale voltage ① shown in FIG. 7.

The reset pulse ⑤ is turned from the H level to the L level at the time t0, as a result the NMOS (NT7) is turned off, the node (N6) is disconnected from the power supply potential (VD). Simultaneously the PMOS (PT7) is turned on, the node (N4) and the node (N5) are connected electrically to each other, furthermore the PMOS (PT11) is turned on, and the node (N6) and the node (NB) are connected electrically to each other. In other words, the output of the NAND circuit is supplied to the input of the inverter circuit (IV1).

At the time t0 three inputs of the NAND circuit are L level, H level, and L level respectively, the output of the NAND circuit is the H level, the gate circuit (GT4) is turned on as in the initial setting, and the gray scale voltage selected by the first selector circuit 123 is supplied to the drain signal line (D).

Accordingly the potential of the drain signal line (D) is turned to the potential of the voltage level at the time t0 of the gray scale voltage ① shown in FIG. 7.

Though three inputs of the NAND circuit is turned to the H level, H level, and L level respectively at the time t1, the output of the NAND circuit is still at the H level, the gate circuit (GT4) remains in the ON state, and the gray scale voltage selected by the first selector circuit 123 is supplied to the drain signal line (D).

Accordingly the potential of the drain signal line is turned to the potential of the voltage level of the gray scale voltage ① shown in FIG. 7 at the time t1.

Similarly at the times t2, t3, and t4, one of three inputs to the NAND circuit is at the L level, the output of the NAND circuit is the H level, the gate circuit (GT4) remains in the ON state, and the gray scale voltage selected by the first selector circuit 123 is supplied to the drain signal line (D).

Accordingly at the times t2, t3, and t4, the potential of the drain signal line (D) is the potential of the voltage level of the gray scale voltage ① shown in FIG. 7 at the times t2, t3, and t4, respectively.

When the time control pulse ④ rises from the L level to the H level at the time t5, all of the three inputs of the NAND circuit become the H level for the first time, and the output of the NAND circuit is turned to the L level. As a result, the node (N5) and the node (N6) are turned to the L level, the output of the inverter circuit (IV1) is turned from the L level to the H level, and the output of the inverter circuit (IV2) is turned from the H level to the L level.

Accordingly the gate circuit (GT4) is turned off, and the gray voltage selected by the first selector circuit 123 is disconnected from the drain signal line. (D) while the potential of the drain signal line (D) is maintained in the potential immediately before time t5, namely, the same potential as the potential at time t5.

Simultaneously the potential of the node (N8) is turned to the L level, as a result the NMOS (NT11) is turned off, and the electric connection between the NAND circuit and the inverter circuit (IV1) is disconnected.

Accordingly after this, this level is maintained until the reset pulse ⑤ becomes the H level and the initial state is established again, regardless of the output of the NAND circuit, namely, the outputs from the switching circuits (SW1 to SW3).

Accordingly the gray scale voltage corresponding to the display data is applied to the pixel by writing the potential of the drain signal line (D) into the pixel before the reset pulse ⑤ is turned to the H level.

Figure 8:
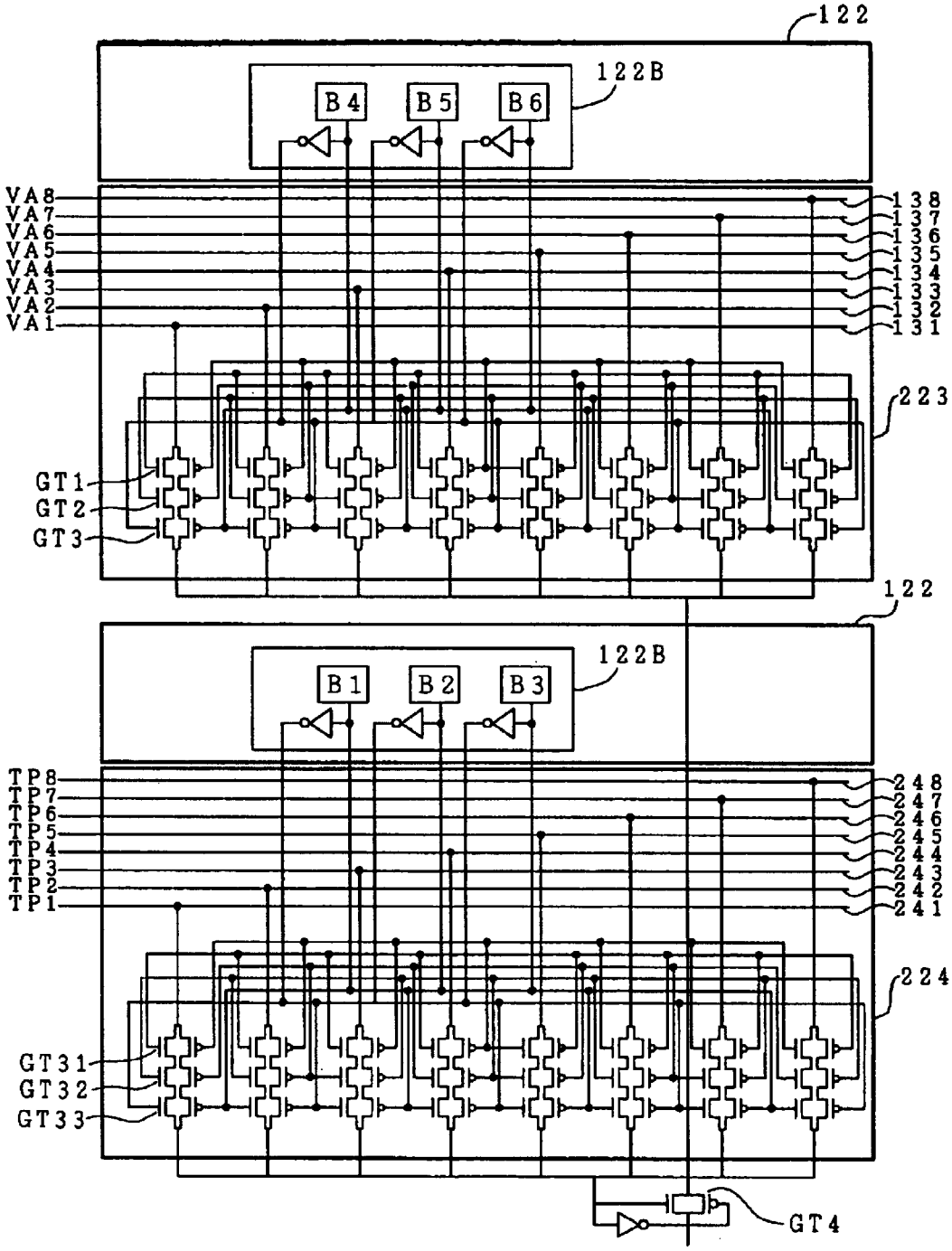
FIG. 8 is a circuit diagram for illustrating a circuit structure of the first selector circuit and the second selector circuit studied by the present inventors before the present invention.

FIG. 8 is a circuit diagram for illustrating the circuit structure of the first selector circuit and the second selector circuit studied by the present inventors before the present invention.

In FIG. 8, the first selector circuit 223 has the same circuit structure as that of the first selector circuit 123 in the first embodiment.

Figure 9:
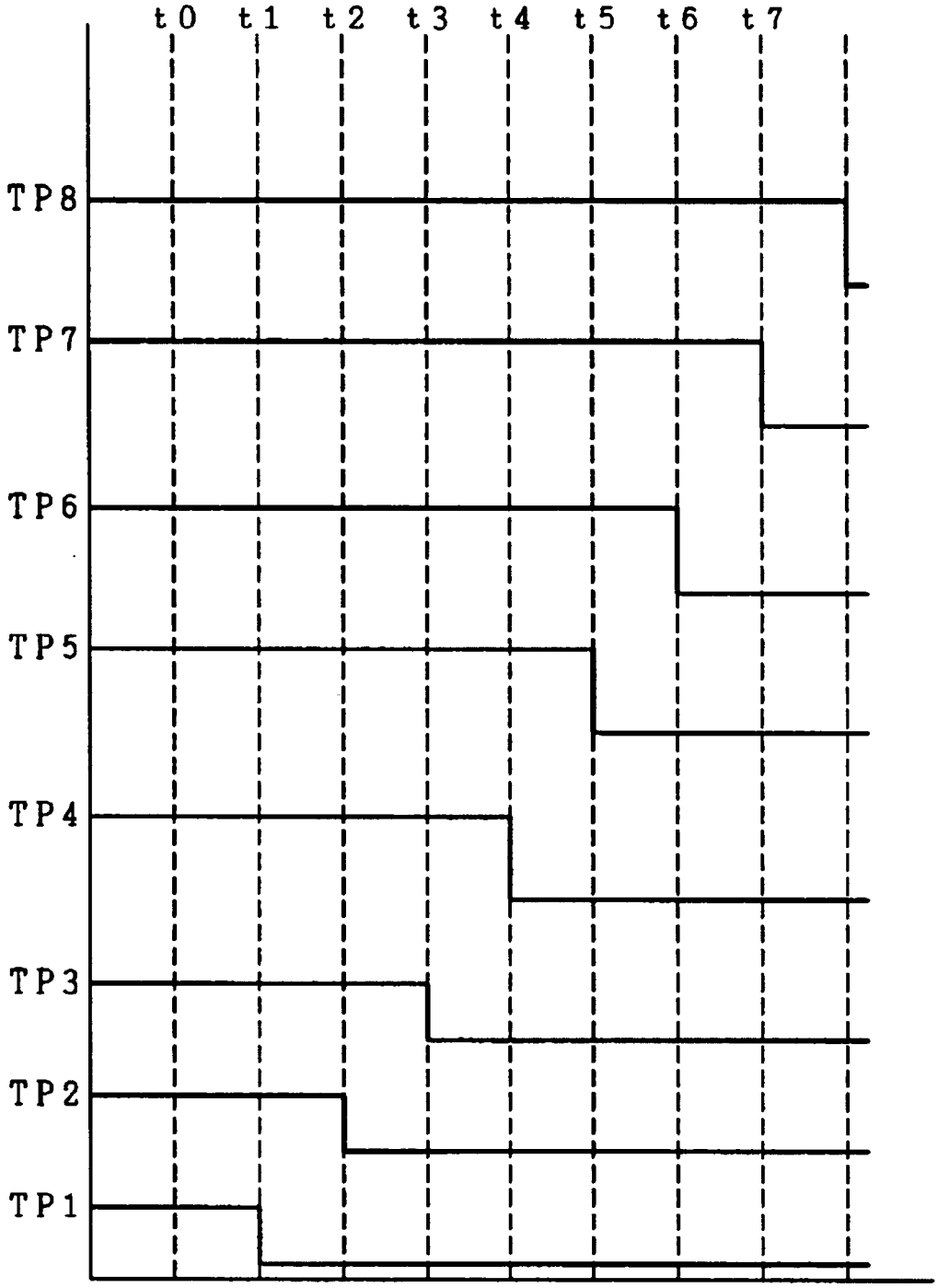
FIG. 9 is a waveform diagram for illustrating the waveform of time control signals (TP1 to TP8) supplied to each time control signal line shown in FIG. 8.

The second selector circuit 224 has a circuit structure similar to that of the first selector circuit 123 of the first embodiment, and selects one of time control signals TP1 to TP8 carried on eight time control signal lines 241 to 248 shown in, FIG. 9 by a specific combination of the noninverted and inverted outputs of the lower-order 3 bits of the display data to be applied to the gate electrodes of the PMOS and NMOS of the respective gate circuits (GT31 to GT33), and turns the gate circuit (GT4) OFF from ON based on the selected time control signal.

The second selector circuit 224 shown in FIG. 8 needs 8 time control signal lines (241 to 248) for the lower-order 3 bits of the display data and needs 6 transistors for each time control signal line, in other words, the second selector circuit 224 needs 48 transistors in total. In a case where these circuits are incorporated in the liquid crystal display panel 10, an area occupied by these circuits is too large, and the large occupied area is disadvantageous.

In a case where the number of bits of the display data is increased to increase the number of steps of gray scales, the display data is configured to have an 8-bit structure to realize a 256-gray scale display, for example, if the display data is divided into the higher-order 4 bits and the lower-order 4 bits and the time control pulse is selected based on the lower-order 4 bits, then 16 time control signal lines are needed and the second selector circuit needs 128 transistors.

As described hereinabove, in the case of the circuit structure shown in FIG. 8, the circuit scale is doubled for every 1 bit increment of the display data for realizing an increased number of steps of gray scales, and the occupied area increases as the number of steps of gray scales is increased.

On the other hand, according to the circuit structure of the second selector circuit 124 of the first embodiment, only 4 time control signal lines are needed including the reset pulse signal line, 20 transistors are needed in total, and the circuit scale is very small in comparison with the circuit structure shown in FIG. 8.

In the first embodiment, although the total number of transistors needed for the first selector circuit 123 and the second selector circuit 124 is 76 for each drain signal line (D), if the number of the higher-order bits is made 2 bits and that of the lower-order bits is made 4 bits by modifying the circuit structure, then the total number of transistors needed for the first selector circuit 123 and the second selector circuit 124 is 46 for each drain signal line (D) (20 for the higher-order bits and 26 for the lower-order bits), and the number of signal lines is 9 (4 for the voltage bus lines and 5 for the time control signal lines) including a reset pulse signal line.

Furthermore if the number of the higher-order bits is made 1 and the number of the lower-bits is made 5, then the total number of transistors needed for the first selector circuit 123 and the second selector circuit 124 is 36 for each drain signal line (D) (6 for the higher bits and 30 for the lower-order bits), and the number of signal lines is 8 (2 for the voltage bus lines and 6 for the time control signal lines) including a reset pulse signal line.

An increased number of bits of the display data for an increased number of steps of gray scales makes a pronounced difference between the circuit structure of the first embodiment and the circuit structure shown in FIG. 8.

For example, if the display data has 8-bit structure and the number of higher-order bits and lower-order bits is 4 respectively, the circuit structure shown in FIG. 8 needs 32 input lines (16 voltage bus lines and 16 time control signal lines), the total number of transistors needed for the first selector circuit 223 and the second selector circuit 224 is 274 for each drain signal line (D) (136 for the higher-order bits and 138 for the lower-order bits), on the other hand, the circuit structure of the first embodiment needs 21 signal lines (16 voltage bus lines and 5 time control signal lines) including a reset pulse signal line, and the total number of transistors needed for the first selector circuit 223 and the second selector circuit 224 is 162 for each drain signal line (D) (136 for the higher-order bits and 26 for the lower-order bits).

In this case, if the number of the higher-order bits is 1 and the number of the lower-order bits is 7, then the circuit structure of the first embodiment needs 10 signal lines (2 voltage bus lines and 8 time control signal lines), and the total number of transistors needed for the first selector circuit 123 and the second selector circuit 124 is 44 for each drain signal line (D) (6 for the higher-order bits and 38 for the lower-order bits).

As described hereinabove, according to the first embodiment, the number of signal lines and the total number of transistors needed for the first selector circuit 123 and the second selector circuit 124 can be reduced.

Second Embodiment

Figure 10:
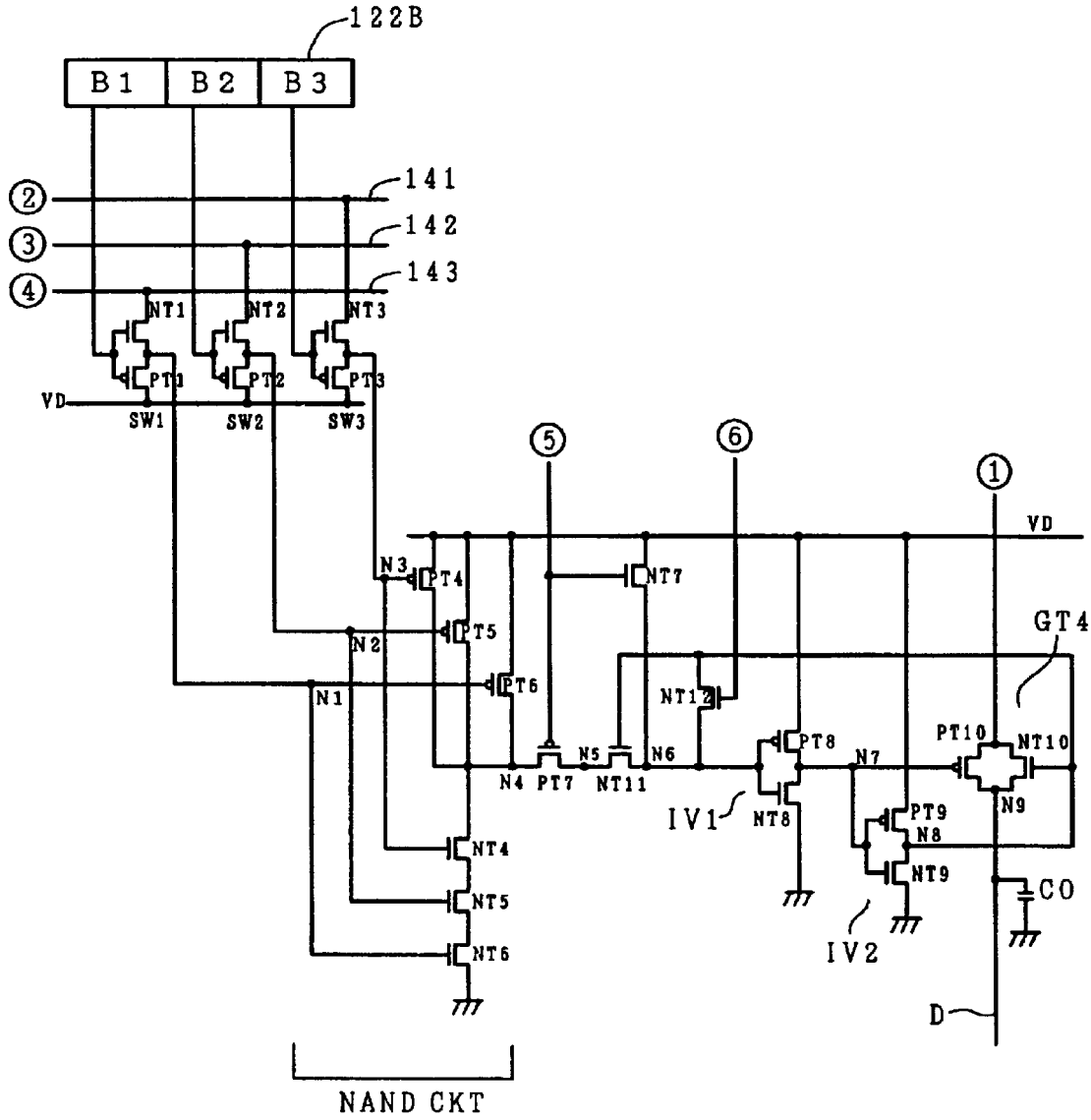
FIG. 10 is a circuit diagram for illustrating a circuit structure of a selector associated with each drain signal line (D) in the second selector circuit the TFT type liquid crystal display module of a second embodiment of the present invention.

FIG. 10 is a circuit diagram for illustrating the circuit structure of the second selector circuit 124 in a TFT type liquid crystal display module in accordance with a second embodiment of the present invention.

Figure 11:
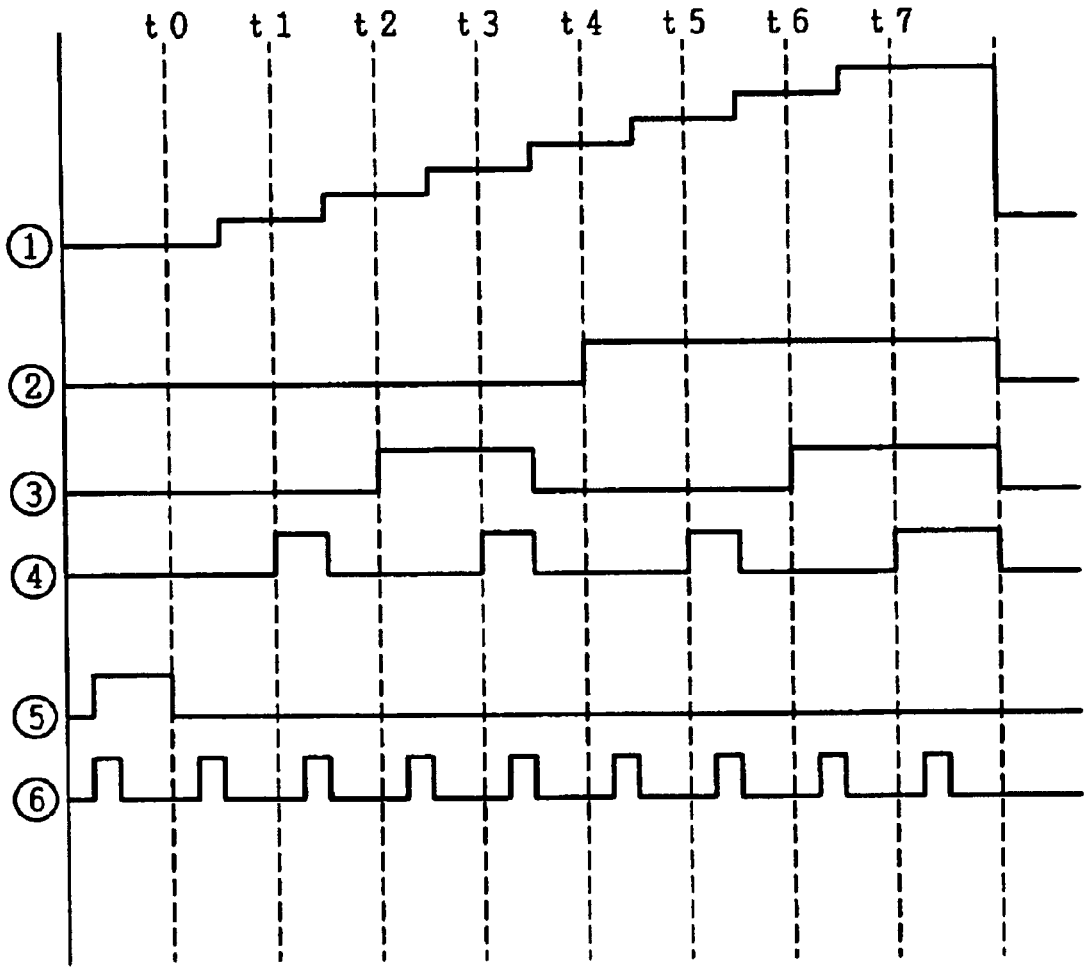
FIG. 11 is a waveform diagram for illustrating the waveform of time control pulses (②, ③, and ④) shown in FIG. 10.

In the second selector circuit 124 of the second embodiment, the NMOS (NT12) is connected between the node (N6) and the node (N8), and a pulse ⑥ shown in FIG. 11 is applied to the gate electrode of the NMOS (NT12) to suppress the voltage variations of the node (N6) due to a dark current or a leakage current.

By the second embodiment, the number of signal lines and the total number of transistors needed for the first selector circuit 123 and the second selector circuit 124 can be reduced.

Third Embodiment

Figure 12:
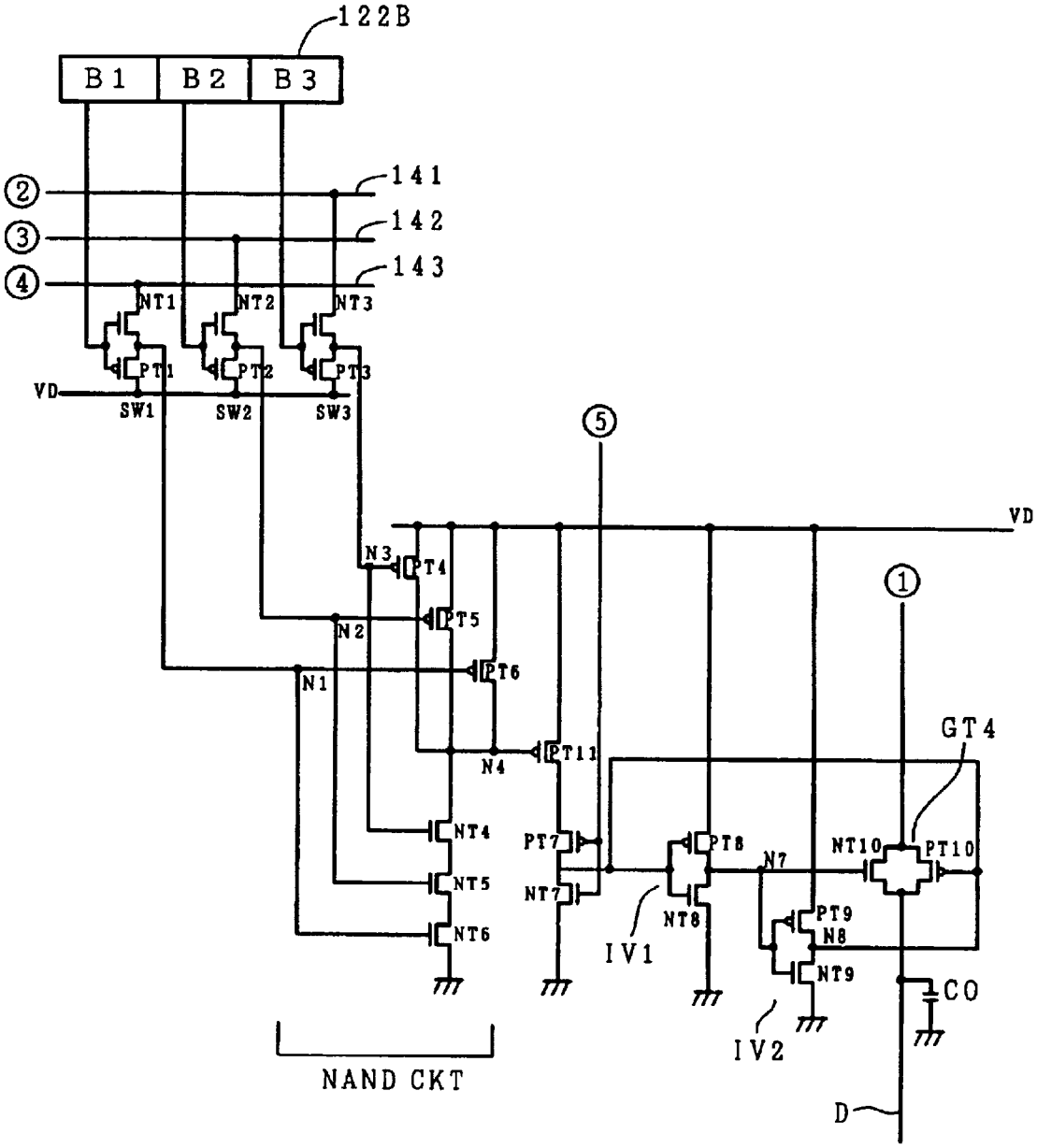
FIG. 12 is a circuit diagram for illustrating a circuit structure of a selector associated with each drain signal line (D) in the second selector circuit in a TFT type liquid crystal display module of a third embodiment of the present invention.
Figure 13A:
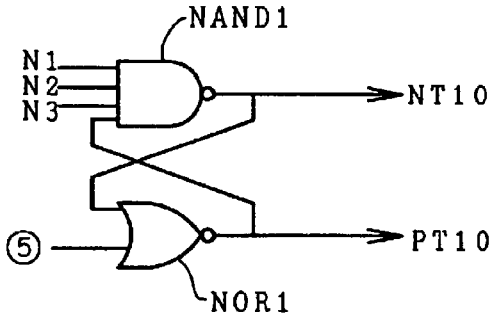
FIGS. 13A to 13D are circuit diagrams for illustrating another circuit structure employable as the second selector circuit in the present invention.
Figure 13C:
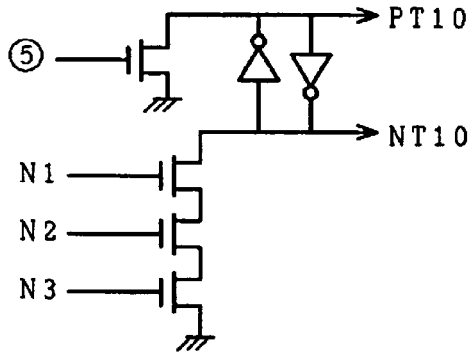
Figure 13B:
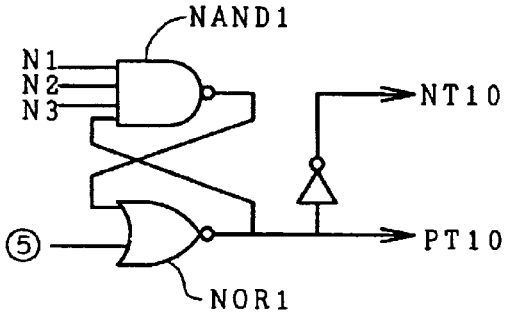
Figure 13D:
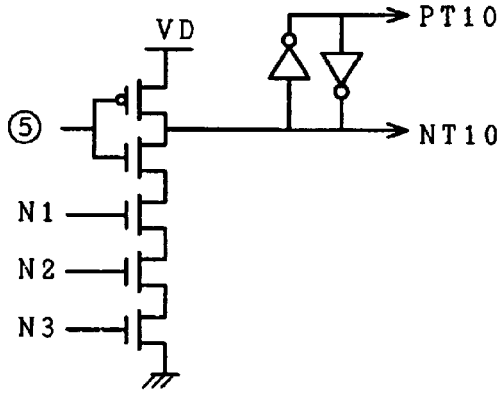

FIG. 12 is a circuit diagram for illustrating the circuit structure of the second selector circuit 124 in a TFT type liquid crystal display module of a third embodiment of the present invention.

The second selector circuit 124 of the third embodiment is different from the second selector circuit 124 of the first embodiment in that the PMOS (PT11) with a gate electrode supplied with the output of the three-input NAND circuit and the PMOS (PT7) and NMOS (NT7) with a gate electrode supplied with the reset pulse are connected between the power supply potential (VD) and the reference potential (GND), and the potential of the connection point, the node (N5) of the PMOS (PT7) and the NMOS (NT7) is inputted to the inverter circuit (Iv1).

In the second selector circuit 124 of the third embodiment, when the reset pulse ⑤ is turned to the H level, the NMOS (NT7) is turned on and the node (N5) is turned to the L level.

As a result, the output of the inverter circuit (IV1) is turned to the H level, the output of the inverter circuit (IV2) is turned to the L level, and the gate circuit (GT4) is turned on.

When the reset pulse ⑤ is turned to the L level, then the NMOS (NT7) is turned off and the PMOS (PT7) is turned on, but in the case where the PMOS (PT11) is off, the node (N5) goes into a floating state.

However, as described in the first embodiment, even though the node (N5) is in the floating state, the gate circuit (GT4) is maintained in the ON state because the inverter circuit (IV1) and the inverter circuit (IV2) constitute a latch circuit.

Similarly to the first embodiment, when the output of the three-input NAND circuit is turned to the L level at time t5, the PMOS (PT11) is turned on and the node (N5) is turned to the H level.

As a result, the output of the inverter circuit (IV1) is turned to the L level, the output of the inverter circuit (IV2) is turned to the H level, and the gate circuit (GT4) is turned off, and this state is maintained until the reset pulse ⑤ is turned to the H level again.

In the third embodiment, the number of signal lines and the total number of transistors needed for the first selector circuit 123 and the second selector circuit 124 can be reduced.

The circuit structure of the second selector circuit 124 in the present invention is by no means limited to the circuit structures shown in the respective embodiments, and for example, the circuit structures shown in FIGS. 13A to 13D may be employed.

In FIGS. 13A to 13D, NAND 1 denotes a NAND circuit and NOR 1 denotes a NOR circuit.

N1, N2, and N3 denote the node (N1), node (N2), and node (N3) shown in FIG. 6 respectively, and PT10 and NT10 located at the ends of the arrow marks represent that these signals are applied to the gate electrode of the PMOS (PT10) and the gate electrode of the NMOS (NT10).

Fourth Embodiment

Figure 14:
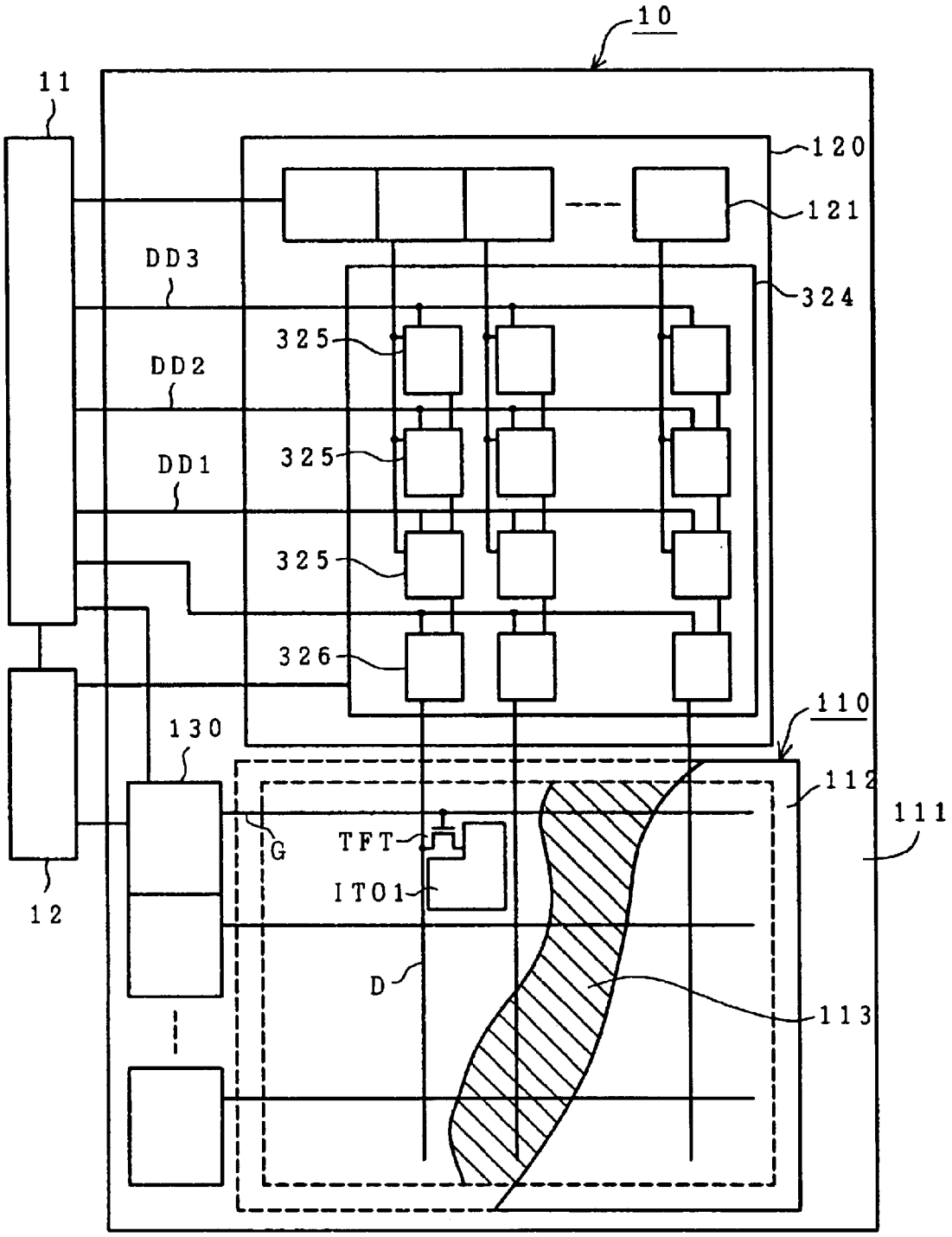
FIG. 14 is a block diagram for illustrating the whole schematic structure of a TFT type liquid crystal display module of a fourth embodiment of the present invention.

FIG. 14 is a block diagram for illustrating the whole schematic structure of a TFT type liquid crystal display module in accordance with a fourth embodiment of the present invention.

The liquid crystal display module of the fourth embodiment comprises a single selector circuit 324 instead of the first selector circuit 123 and the second selector circuit 124 in the above-mentioned embodiments.

In FIG. 14, a display section 110 comprises a pair of opposing substrates 111, 112, at least one of which is transparent, a liquid crystal layer 113 sandwiched between the pair of opposing substrates, and a plurality of pixels arranged in a matrix. Each pixel is disposed in a region enclosed by two adjacent gate signal lines (scanning signal lines or horizontal signal lines) (G) and two adjacent drain signal lines (video signal lines or vertical signal lines) (D).

Each pixel has a thin film transistor (TFT) comprising a poly-silicon transistor, for example, and each thin film transistor (TFT) of each pixel is connected to a pixel electrode (ITO1). In FIG. 14, a thin film transistor (TFT) is represented by a circuit symbol for the purpose of simplifying the drawing. Only one pixel is indicated, but actually a plurality of pixels are arranged in the form of a matrix.

A gray scale voltage corresponding to display data is supplied to each pixel by way of each drain signal line (D). The selector circuit 324 selects a gray scale voltage corresponding to display data and supplies it to each drain signal line (D). Each pixel is disposed between two adjacent drain signal lines (D).

Display data is supplied to the selector circuit 324 through the data lines DD1 to DD3. Three data lines are used in the fourth embodiment for 3 bit display data. It is possible to select the number of data lines arbitrarily corresponding to the display data.

The data lines DD1 to DD3 are connected to a display data processing circuit 325 incorporated in the selector circuit 324. The display data processing circuit 325 processes the display data. A gray scale voltage output circuit 326 outputs a gray scale voltage based upon the result of processing in the display data processing circuit 325.

The display data processing circuit 325 and the gray scale voltage output circuit 326 are provided for each drain signal line (D). The separate display data processing circuit 325 is provided for every data line (DD1 to DD3). Three data lines are provided in the fourth embodiment, and accordingly three display data processing circuits 325 are provided for each drain signal line. By dividing and separating the display data processing circuit 325 from each other, the display data processing circuit 325 is allowed to be provided for each data line, and the display data processing circuit 325 is arranged in conformity with the arrangement of the data lines (DD1 to DD3). In the fourth embodiment, the display data processing circuit 325 is disposed near the intersection of the extension line of the drain signal line and the data lines (DD1 to DD3). A spacing between two adjacent data lines is made so sufficient to dispose an individual display data processing circuit 325 therein.

A spacing between two adjacent data lines is sufficient compared with the spacing between two adjacent drain signal lines (D) which is limited by the size of a pixel. The display data processing circuits 325 are arranged in conformity with the arrangement of the data lines (DD1 to DD3) so as to secure an area for the display data processing circuits 325. The region where the display data processing circuit 325 is disposed is enclosed by two adjacent drain signal lines (D) and two adjacent data lines, and the display data processing circuits 325 are arranged on an extension line of the drain signal line (D) in a line.

In the case of the liquid crystal display element 10 having the horizontal scanning circuit 120 and the display section 110 on the same substrate, the horizontal scanning circuit 120 is disposed on a limited area near the display section 110. The arrangement of the display data processing circuits 325 and the gray scale voltage output circuits 326 which constitute the horizontal scanning circuit 120 is also limited. The display data processing circuit 325 is disposed on the extension line of the drain signal line (D) within a spacing between two adjacent drain signal lines (D) in a line side by side and the limited area is used effectively.

As described above, in the display section 110 each pixel is sandwiched between two adjacent drain signal lines (D). The display data processing circuits 325 and the gray scale voltage output circuit 326 are provided for each drain signal line. As a result, if the width of the region where the display data processing circuits 325 and the gray scale voltage output circuit 326 are formed exceeds the spacing between two adjacent drain signal lines, there arises a problem in that the two adjacent regions where the display data processing circuits 325 and the gray scale voltage output circuit 326 are formed overlap each other. In the fourth embodiment, each display data processing circuit 325 is capable of being disposed within a spacing between two adjacent drain signal lines (D) because one display data processing circuits 325 is provided for each data line separately in a line side by side on the extension line of the drain signal line (D).

Furthermore, in the fourth embodiment, each display data processing circuit 325 is disposed adjacently to each data line. As a result, the wirings from the data lines DD1, DD2, and DD3 to the respective display data processing circuits 325 can be shortened. If other circuits or wirings are disposed between the data lines DD1, DD2, and DD3 and the display data processing circuits 325, it is difficult to dispose necessary structural components within the limited spacing between two drain signal lines (D) because wiring from the data lines to the other circuits and wiring is needed.

Figure 15:
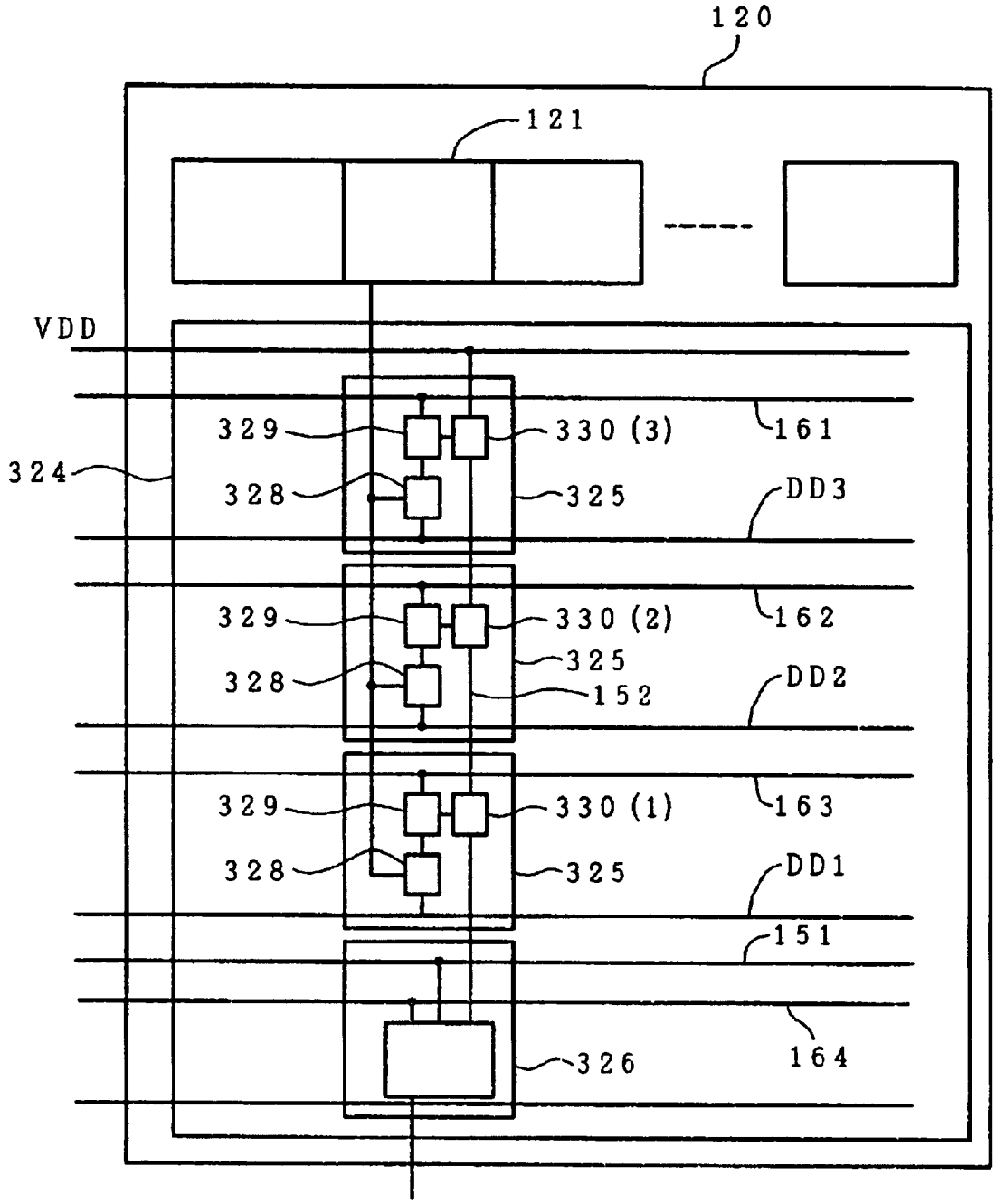
FIG. 15 is a block diagram for illustrating a circuit structure of a horizontal scanning circuit for a case of 3-bit display data in the fourth embodiment of the present invention.

FIG. 15 is a block diagram for illustrating the circuit structure of the horizontal scanning circuit 120 for 3-bit display data. In FIG. 15, the structure of the selector circuit 324 for one drain signal line (D) only is indicated for the purpose of simplifying the illustration. The selector circuit 324 is provided with the display data processing circuits 325. The display data processing circuits 325 is provided for each of the data lines DD1 to DD3, and the time control signal lines 161 to 163 are connected to the display data processing circuits 325 respectively. The reference numeral 328 denotes a display data hold circuit, which stores the display data from each of the data lines DD1 to DD3 in accordance with a timing signal from the horizontal shift register 121. The reference numeral 329 denotes processing circuits, which produce signals according to combinations of the outputs of the display data hold circuit 328 and the signals from the time control signal lines 161 to 163 and outputs the process results to the process-result transmitting circuits 330(1) to (3). The gray scale voltage output circuit 326 selects a gray scale voltage based on the process result and outputs it. The process-result transmitting circuits 330 (1) to (3) are connected to each other in series by a process-result signal line 152. The process-result transmitting circuits 330(1) to (3) and the gray scale voltage output circuit 326 are connected to each other in series by the process-result signal line 152. The wiring region for wiring for separate connections between the respective processing circuits 329 and the gray scale voltage output circuit 326 can be omitted because the process-result transmitting circuits 330(1) to (3) and the gray scale voltage output circuit 326 are connected in series by the process-result signal line 152.

In the display data processing circuits 325, the processing circuits 329 produce signals according to combinations of the data from the display data hold circuits 328 and the time control signals of the time control signal lines 161 to 163, and transmit the process-results to the respective process-result transmitting circuits 330(1) to (3). Because the display data hold circuits 328 and processing circuits 329 are provided to respective data lines DD1 to DD3, it is possible to shorten the wiring between the display data hold circuit 328 and the processing circuit 329.

The voltage bus line 151 is connected to the gray scale voltage output circuit 326. A voltage carried on the voltage bus line 151 varies with a fixed period. Time control signals from the time control signal lines 161–163 are used for the display data from the data line DD1 to DD3 to select a voltage level of the gray scale voltage on the voltage bus line 151 corresponding to the display data.

The selector circuit 324 selects one voltage level from the gray scale voltage on the voltage bus line 151 in accordance with display data outputted from the display control circuit ii shown in FIG. 14 and outputs it. The gray scale voltage on the voltage bus line 151 varies with time periodically. Selection of a desired voltage level from the gray scale voltage on the voltage bus line 151 is performed by sampling and holding the desired voltage level when the gray scale voltage reaches the desired level on the voltage bus line 151. Time when the gray scale voltage on the voltage bus line 151 reaches a desired voltage level is uniquely determined, and therefore selection of the desired voltage level is performed by designation of the time.

The selector circuit 324 produces signals according to combinations of data from the data lines DD1 to DD3 and time control signals from the time control signal lines 161 to 163 such that a desired voltage level is selected from the gray scale voltage on the voltage bus line 151 by designating a time for sampling the gray scale voltage based upon the produced signals.

The time control signals from the time control signal lines 161 to 163 are configured to vary with time such that the time control signals and the data from the data lines DD1 to DD3 produce a signal for designating a time corresponding to a respective voltage level of the gray scale voltage from the voltage bus line 151 uniquely.

FIG. 15 illustrates an example of three-bit display data using three data lines DD1 to DD3 and three time control signal lines 161 to 163. Display data are processed in the respective circuits associated with each of the data lines DD1 to DD3.

A signal produced from the data from the data line DD1 and the time control signal line 163, a signal produced from the data from the data line DD2 and the time control signal line 162, and a signal produced from the data from the data line DD3 and the time control signal line 161 are outputted to the process-result transmitting circuits 330(1), 330(2) and 330(3), respectively.

The process-result transmitting circuits 330(1), 330(2) and 330(3) perform logic operation by the outputs from the respective processing circuits 329 and outputs the results to gray scale voltage output circuit 326.

When the process-result transmitting circuits 330(1), 330(2) and 330(3) are switching circuits, they are connected in series via the process-result signal line 152 and the states represented by them are only the following two states:

one is a state in which all the process-result transmitting circuits are turned on and the voltage VDD is transmitted to the gray scale voltage output circuit 326, and the other is a state in which at least one of the process-result transmitting circuits is turned off and the voltage VDD is not transmitted to the gray scale voltage output circuit 326.

This embodiment is configured such that each of N process-result transmitting circuits 330 can be selected to act as a switching circuit. With this structure, the N process-result transmitting circuits 330 can represent $2^N$ states, though they are connected in series via the process-result signal line 152.

Table 1 shows combinations of the three process-result transmitting circuits 330(1), 330(2) and 330(3) acting as a switching circuit. In Table 1, "-" indicates that a process-result transmitting circuit is on at times. Although the three process-result transmitting circuits 330(1), 330(2) and 330(3) are switching circuits, if they are selected to be on at all times, they can be considered absent.

TABLE 1

| Process-result transmittance circuit | Case 1 | Case 2 | Case 3 | Case 4 | Case 5 | Case 7 | Case 8 | Case 9 |
|---|---|---|---|---|---|---|---|---|
| 330 (3) | — | — | — | — | SW | SW | SW | SW |
| 330 (2) | — | — | SW | SW | — | — | SW | SW |
| 330 (1) | — | SW | — | SW | — | SW | — | SW |

In Table 1, SW indicates that the process-result transmitting circuit 330 functions as a switching circuit. In a case where switching circuits are connected in series, only two states are selectable, one is that all the switching circuits are ON and the other one is that at least one switching circuit is OFF. In a case where there is n switching circuits, there are $2^n$ states. As a result, if the processing circuit 329 outputs the process-result which turns on a switching circuit at an arbitrary time in synchronism with the gray scale voltage on the voltage bus line 151 based on the data of the time control signal line, and then the gray scale voltage of the voltage bus line 151 at the time when the switching circuit is turned on is selected.

Figure 16A:
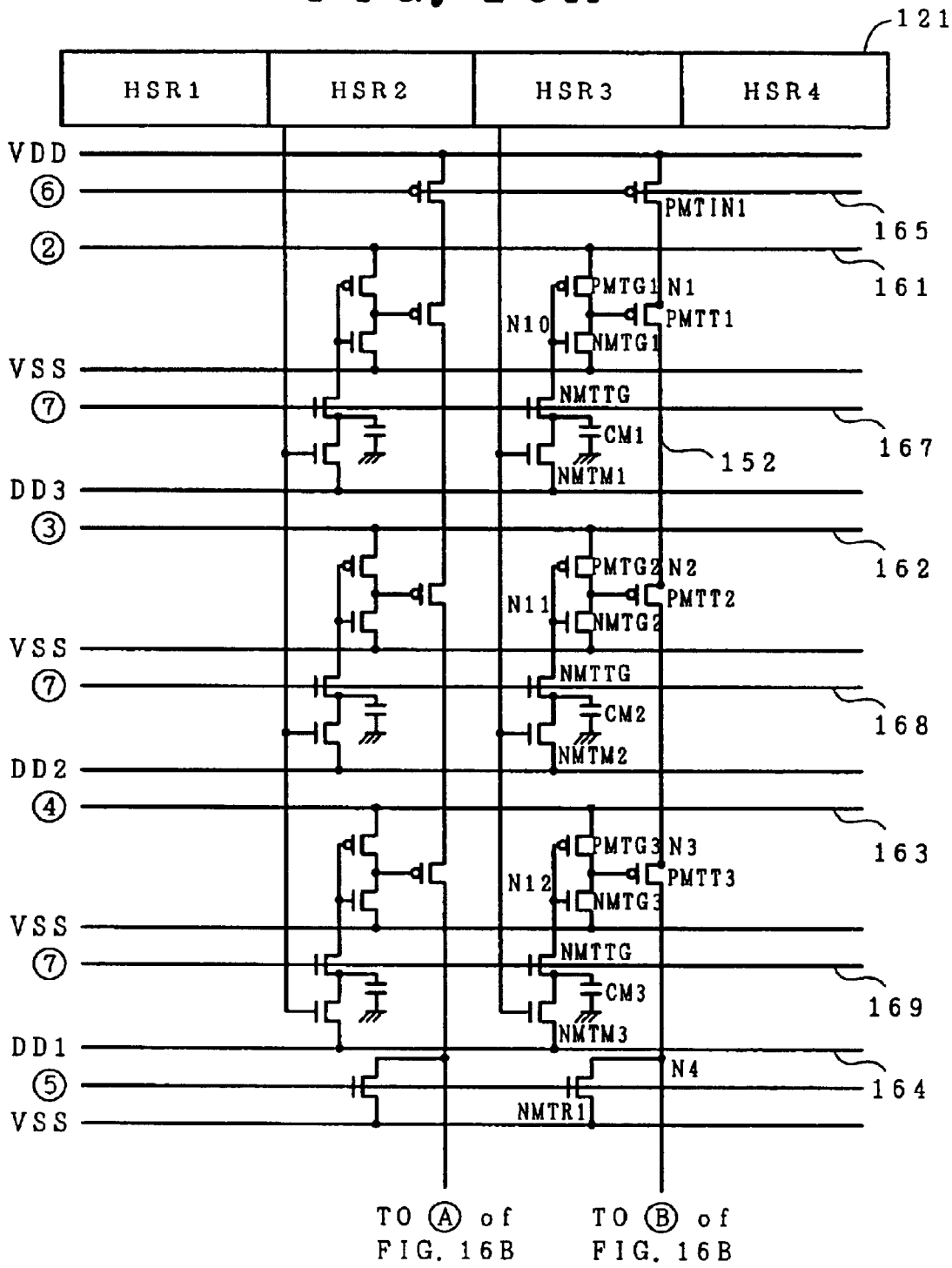
FIGS. 16A and 16B in combination are a circuit diagram for illustrating a circuit structure of a selector circuit for the case of the 3-bit display data in the fourth embodiment of the present invention.
Figure 16B:
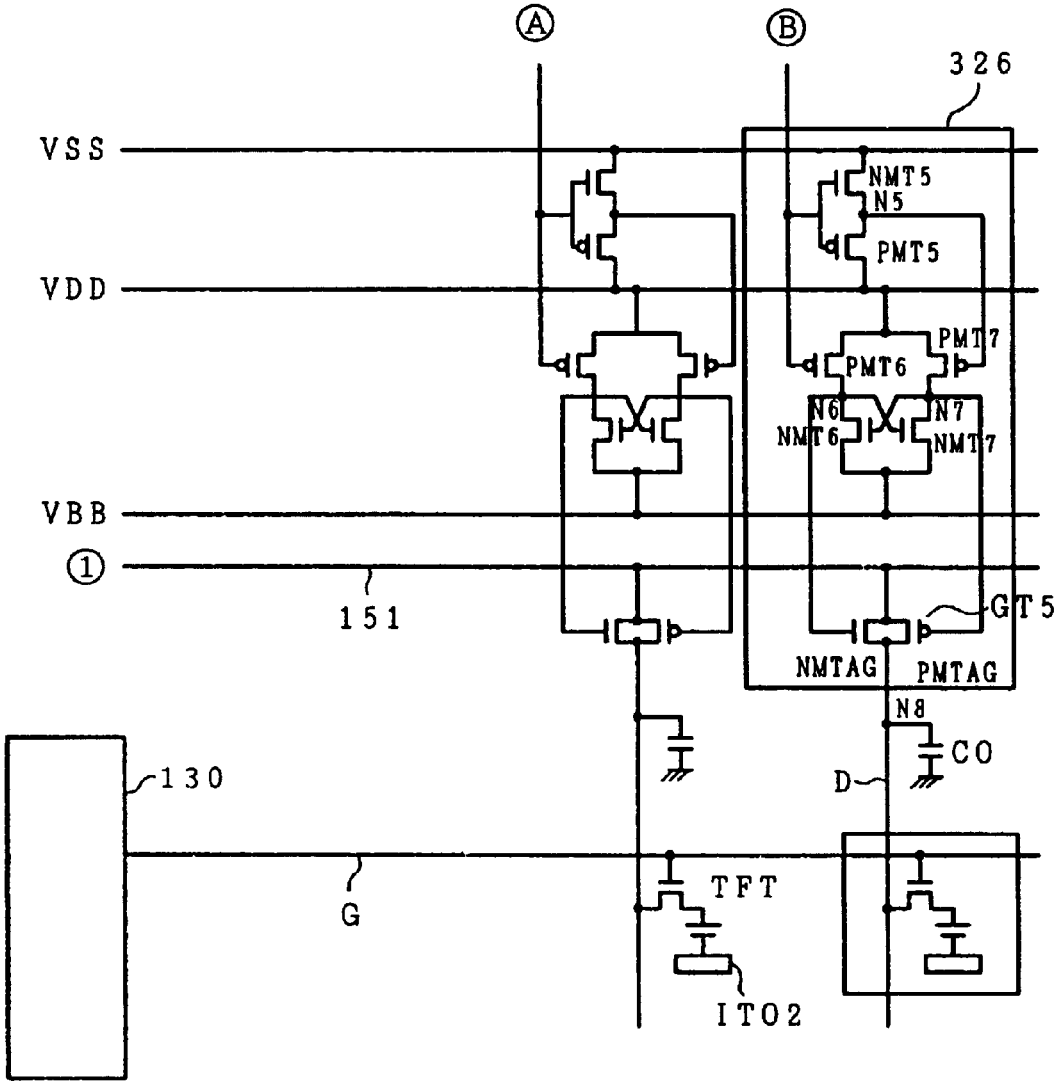

FIGS. 16A and 16B in combination are a circuit diagram for illustrating the circuit structure of the selector circuit 324 for 3-bit display data in the fourth embodiment.

Figure 17:
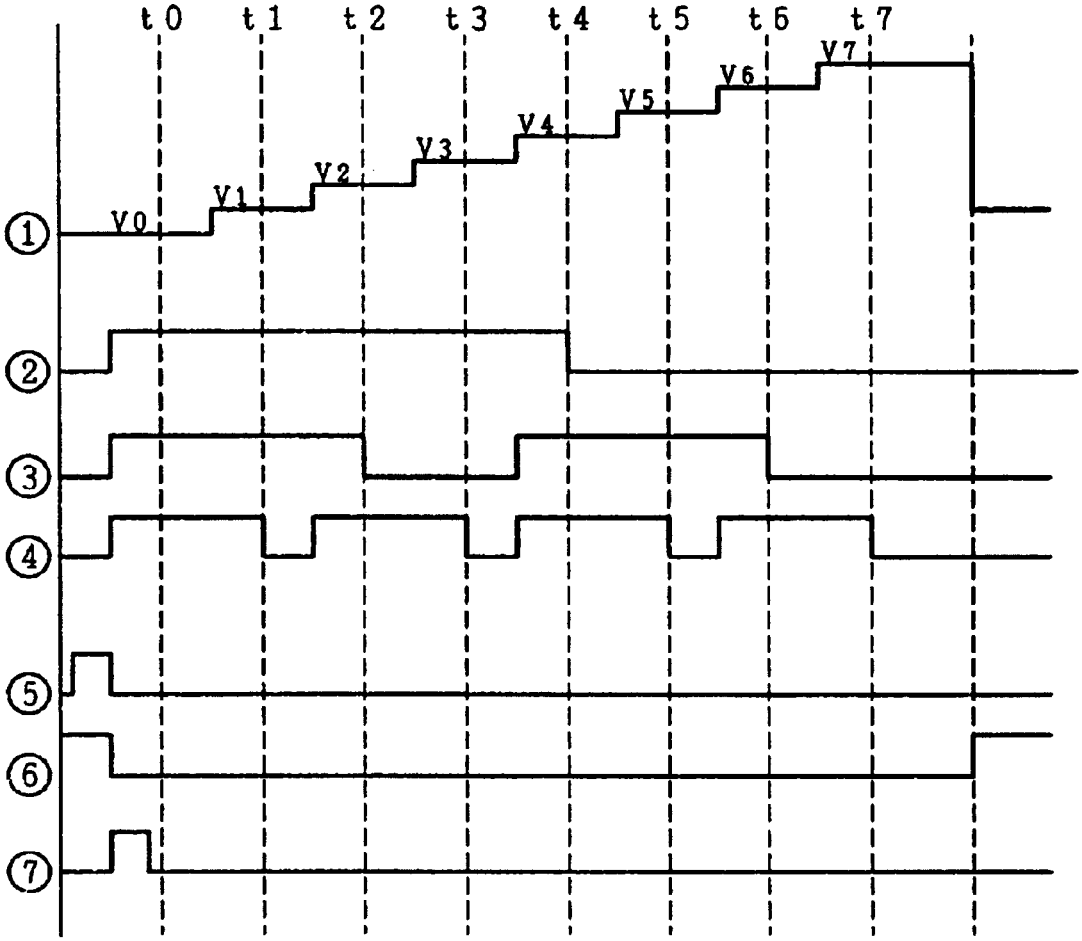
FIG. 17 is a waveform diagram for illustrating the waveform of time control pulses (②, ③, ④, ⑤, ⑥, and ⑦) shown in FIG. 15.

In the liquid crystal display module of the present embodiment, the number of the voltage bus line in the selector circuit 324 is 1, and the gray scale voltage varying in a staircase fashion having eight steps as shown at ① in FIG. 17 is supplied to the voltage bus line 151.

Furthermore the reference numerals 161 to 169 are time control signal lines, and time control pulses having the waveforms as shown at ② to ⑦ shown in FIG. 17 are supplied to the time control signal lines 161 to 169.

In FIGS. 16A and 16B, DD1 denotes the lowest-order bit, DD2 denotes the second bit data line, DD3 denotes the third bit data line, and CM1, CM2, and CM3 denote memory capacitances.

Figure 19:
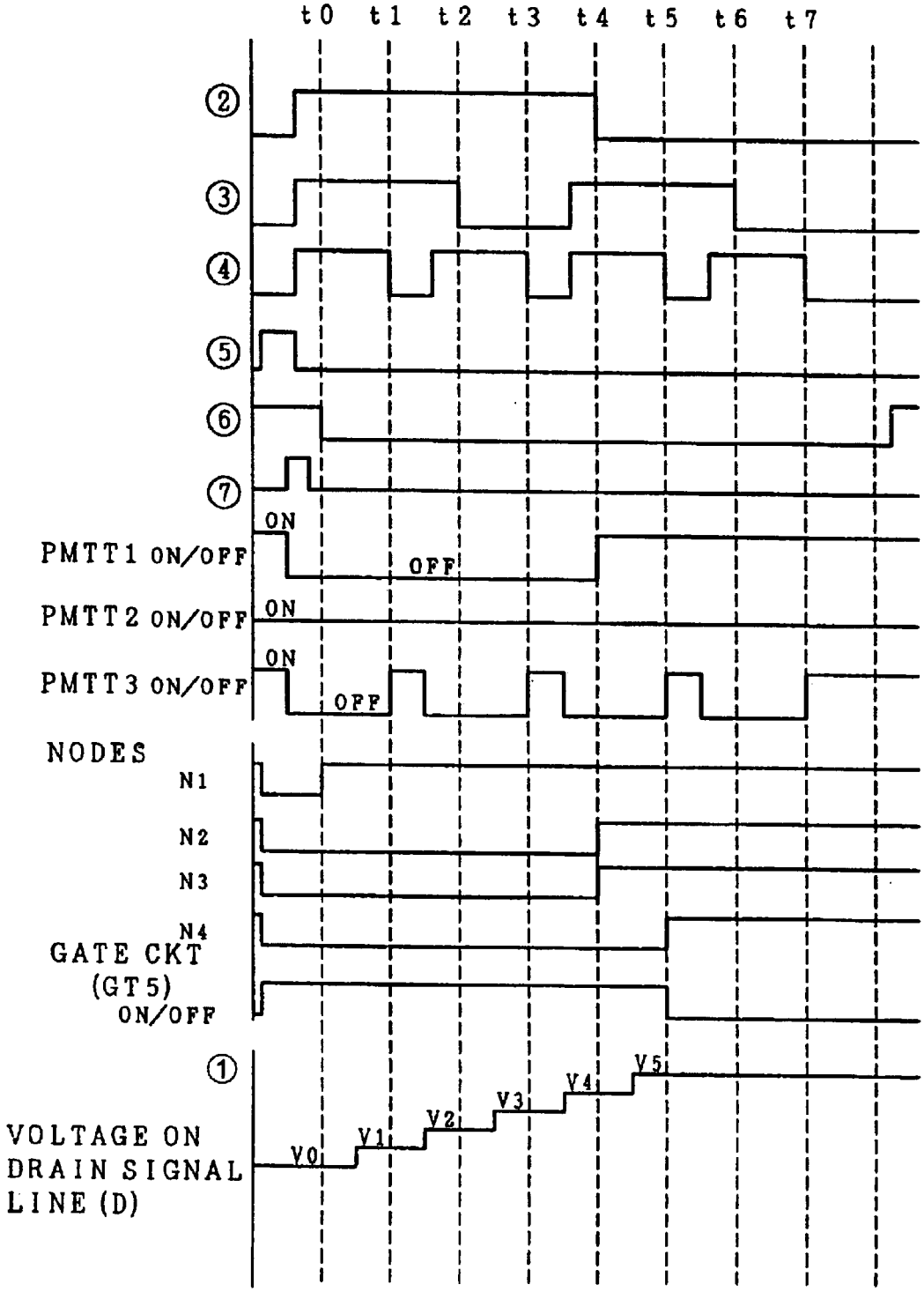
FIG. 19 is a waveform diagram for illustrating ON/OFF conditions and respective node (N1 to N4) potentials of respective PMOS (PMTT1 to PMTT3) in the fourth embodiment of the present invention.

The operation of the selector circuit 324 in a case where 3-bit display data is (1, 0, 1) in the circuit shown in FIGS. 16A and 16B is described hereinunder. FIG. 19 is a timing chart for explaining the operation.

First, the display data is taken into the memory capacitances (CM1, CM2, CM3) which constitute the display data hold circuits 328. In the selector circuit 324 of the present embodiment, a positive bias voltage is applied to each gate signal line (G) during each scanning period to write a gray scale voltage into each pixel connected to the gate signal line. The display data is taken into the selector circuit 324 before the gray scale voltage is written into the pixel. The display data to be written into pixels connected to the (n+1)st gate signal line is inputted into the selector circuit 324 during the time when the gray scale voltages are written into the respective pixels connected to the nth gate signal line.

In the circuit shown in FIGS. 16A and 16B, the output terminal (HSR3) of the horizontal shift register circuit 121 of the horizontal scanning circuit 120 (see FIG. 15) outputs the H-level display data input shift pulse (SH) within one horizontal scanning period. When a display data input shift pulse (SH) is outputted, and the node (N9) is turned to the H level, then the respective data input transistors (NMTM1 to NMTM3) are turned on, and the voltage corresponding to each bit value of the 3-bit display data is stored from the respective data lines (DD1 to DD3) in the respective memory capacitances (CM1, CM2, and CM3).

Figures 18A, 18B:
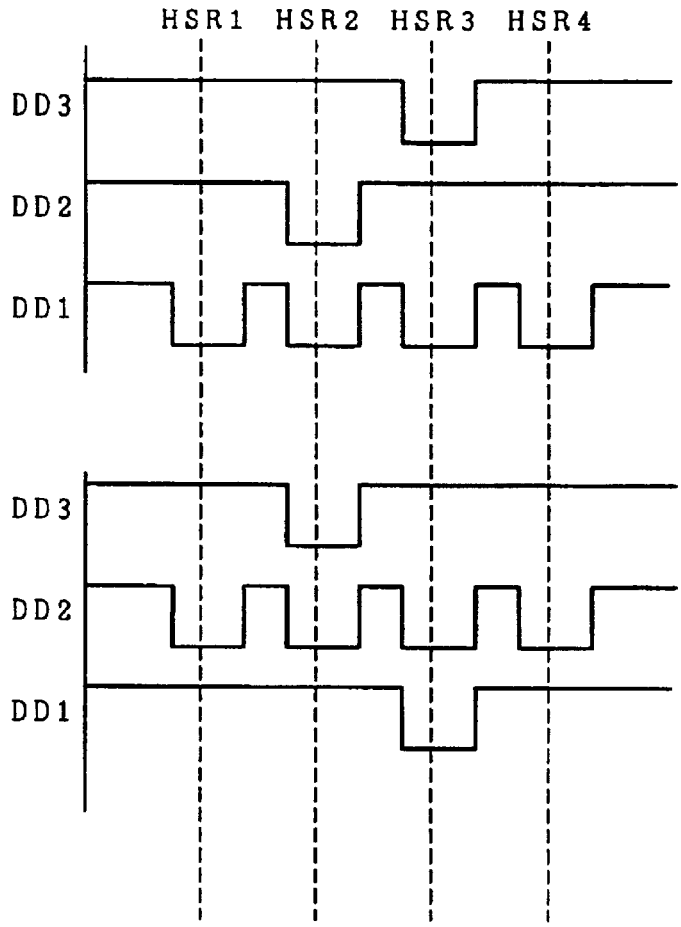
FIGS. 18A and 18B are waveform diagrams for illustrating the voltage levels of the display data in the fourth embodiment of the present invention respectively.

As shown in FIG. 18A, the display data "1" is assigned to the L level and the display data "0" is assigned to the H level. Therefore, if the display data is "1", the voltage level to be stored in the memory capacitance is the L level. Assuming that a case in which a voltage corresponding to a 3-bit display data of (1, 0, 1) is stored in the memory capacitances (CM1, CM2, and. CM3), the voltage level held in the memory capacitance (CM1) is the L level, the voltage level of the memory capacitance (CM2) is the H level, and the voltage level of the memory capacitance (CM3) is the L level.

In the selector circuit 324 of this embodiment, each voltage corresponding to the respective bits of the three-bit display data is stored into the corresponding one of the memory capacitances (CM1 to CM3) during one horizontal scanning period, one horizontal scanning period earlier than one horizontal scanning period when the corresponding gray scale voltages are written into the respective pixels.

In the next scanning period, because the pulse ⑥ shown in FIG. 19 is held in the H level during the time up to t0 shown in FIG. 19, the process-result signal line reset transistor (PMTIN1) connected to the process-result signal line 152 remains OFF.

After this, the reset pulse ⑤ shown in FIG. 19 is turned to the H level, and then the gray scale voltage output circuit reset transistor (NMTR1) is turned on.

In this case, since all the process-result transmitting transistors (PMTT1 to PMTT3) are on, all the nodes (N1 to N4) are set at the L level (a negative power supply potential (Vss)).

The PMOS (PMT5, PMT6, and PMT7) and the NMOS (NMT5, NMT6, and NMT7) of the gray scale voltage output circuit 326 constitute a level shift circuit for receiving the potential of the node (N4) as the input, and when the potential of the node (N4) is the L level, the first output of the level shift circuit (node N6) is the H level and the second output of the level shift circuit (node (N7)) is the L level.

As a result, the gate circuit (GT5) comprising the PMOS gate transistor (PMTAG) and the NMOS gate transistor (NMTAG) is turned on, and a voltage of the V0 level of the gray scale voltage shown at ① shown in FIG. 19 is outputted from the gate circuit (GT5).

Next, the pulse ⑦ shown in FIG. 19 is turned from the L level to the H level, and the memory data transmitting transistors (NMTTG1 to NMTTG3) are turned on, and the potential stored in the respective memory capacitances (CM1, CM2, and CM3) are transmitted to the gates of the processing transistors (PMTG1 to PMTG3 and NMTG1 to NMTG3) which constitute the display data processing circuit 325. The respective gates of the processing transistors (PMTG1 to PMTG3 and NMTG1 to NMTG3) hold voltage levels stored one horizontal scanning period earlier, and consequently the respective potentials at the nodes (N10, N11, and N12) are determined by, voltage division based upon the associated capacitances of the voltage levels stored in the respective gates and the potential levels stored in the memory capacitances (CM1 to CM3).

The potentials at the nodes (N10, N11, and N12) in this state are inputted to the respective display data processing circuits 325 which are CMOS inverters comprising PMOS processing transistors (PMTG1, PMTG2 and PMTG3) and NMOS processing transistors (NMTG1, NMTG2 and NMTG3), respectively. The display data processing circuits 325 perform the same operation as the switching circuits (SW1 to SW3). But the order of the arrangement of PMOS and NMOS transistors is reverse from that in FIG. 6, and the polarity of the output signals is reversed.

In the display data processing circuit 325, the gate capacitances of the respective PMOS processing transistors (PMTG1 to PMTG3) and the respective NMOS processing transistors (NMTG1 to NMTG3), and the capacitance values of the respective memory capacitances (CM1 to CM3) are set so as to reflect the H level or L level stored in the memory capacitances (CM1 to CM3). It is also possible to form the display data hold circuit 328 by inverter circuits. For example, a latch circuit is formed by two inverter circuits like the inverter circuits IV1 and IV2 shown in FIG. 12, and this latch circuit can be used as the display data hold circuit 328.

In this case, the number of transistors to be used increases, but setting of a capacitance value is not needed.

When the pulse ⑦ shown in FIG. 19 becomes from the L level to the H level, either the PMOS processing transistors (PMTG1 to PMTG3) or the NMOS processing transistors (NMTG1 to NMTG3) of the display data processing circuits 325 are turned on in accordance with a voltage level stored in the memory capacitances (CM1 to CM3), and consequently the voltage of (Vss) or one of the time control pulses ②, ③, and ④ is applied to the gate electrodes of the respective process-result transmitting transistors (PMTT1 to PMTT3).

Table 2 lists levels of the nodes, the ON/OFF states of the PMOS processing transistors (PMTG1 to PMTG3) and the NMOS processing transistors (NMTG1 to NMTG3) of the display data processing circuits 325, and connections of the gate electrodes of the respective process-result transmitting transistors (PMTT1 to PMTT3), for the state explained above.

TABLE 2

| Nodes | Node Levels | PMTG1 to PMTG3 | NMTG1 to NMTG3 | Connections of PMTT1 to PMTT3 |
|---|---|---|---|---|
| N10 | Low | ON | OFF | ② |
| N11 | High | OFF | ON | Vss (= Low) |
| N12 | Low | ON | OFF | ④ |

After this, the pulse ⑦ is turned from the H level to the L level, but the state shown in Table 2 remains unchanged.

Next, at time t0, the pulse ⑥ shown in FIG. 19 is turned from the H level to the L level, the process-result signal line reset transistor (PMTIN1) is turned on, and the potential of the node N1 is turned to the potential of VDD (the H level).

The ON/OFF state of the process-result transmitting transistors PMTT1 to PMTT3 and the voltage levels of the nodes (N1 to N7) at this time are listed in Table 3.

TABLE 3

| PMTT1 | PMTT2 | PMTT3 | N1 | N2 | N3 | N4 | N5 | N6 | N7 | GT5 | N8 |
|---|---|---|---|---|---|---|---|---|---|---|---|
| OFF | ON | OFF | High | Low | Low | Low | High | High | Low | ON | V0 |

In Table 3, the voltage level of the node N8 represents the voltage level of the drain signal line (D). The same is true for Table 4 to Table 10. Next, at time t1, the time control pulse ④ shown in FIG. 19 is turned from the H level to the L level and the process-result transmitting transistor (PMTT3) is turned on, but the voltage levels of the nodes (N1 to N7) are not changed and the gate circuit (GT5) remains in the ON state because the process-result transmitting transistor PMTT1 is OFF.

The ON/OFF state of the process-result transmitting transistors (PMTTT1 to PMTT3) and the voltage levels of the nodes (N1 to N7) immediately after time t1 are listed in Table 4.

TABLE 4

| | | | Immediately after t1 | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| OFF | ON | ON | High | Low | Low | Low | High | High | Low | ON | V1 |

Similarly at times t2 and t3, since the process-result transmitting transistor (PMTT1) is OFF, the voltage levels of the nodes (N1 to N7) are not changed, and the gate circuit (GT5) remains in the ON state. The ON/OFF state of the process-result transmitting transistors (PMTT1 to PMTT3) and the voltage levels of the nodes (N1 to N7) immediately after times t2 and t3 are listed in Tables 5 and 6.

TABLE 5

| Immediately after time t2 | | | | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| OFF | ON | OFF | High | Low | Low | Low | High | High | Low | ON | V2 |

TABLE 6

| Immediately after time t3 | | | | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| OFF | ON | ON | High | Low | Low | Low | High | High | Low | ON | V3 |

At time t4, the time control pulse ② shown in FIG. 19 is turned from the H level to the L level, the process-result transmitting transistor (PMTT1) is turned on, and the nodes (N1, N2, and N3) are turned to the H level. However, since the time control pulse ④ shown in FIG. 17 is the H level, the voltage levels of the nodes (N4 to N7) are not changed, and the gate circuit (GT5) remains in the ON state.

The ON/OFF state of the process-result transmitting transistors (PMTT1 to PMTT3) and the voltage levels of the nodes (N1 to N7) immediately after time t4 are listed in Table 7.

TABLE 7

| Immediately after time t4 | | | | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| ON | ON | OFF | High | High | High | Low | High | High | Low | ON | V4 |

At time t5, since the time control pulse ④ shown in FIG. 19 is turned to the L level, the node (N4) is turned to the H level and the node (N5) is turned to the L level, and accordingly the node (N6) is turned to the L level and the node (N7) is turned to the H level.

As a result, the gate circuit (GT5) is turned off, and the potential of the drain signal line (D) is turned to the voltage level at the time immediately before time t5.

The ON/OFF state of the process-result transmitting transistors (PMTT1 to PMTT3) and the voltage levels of the nodes (N1 to N7) immediately after time t5 are listed in Table 8.

TABLE 8

| Immediately after time t5 | | | | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| ON | ON | ON | High | High | High | High | Low | Low | High | OFF | V5 |

After this, until the reset pulse ⑤ becomes the H level and the initial state is established, the ON/OFF state of the process-result transmitting transistors (PMTT1 to PMTT3) and the voltage levels of the nodes (N1 to N7) are maintained unchanged regardless of the voltage levels of the time control pulses shown in FIG. 17.

Accordingly, the potentials of the drain signal lines (D) are written into pixels before the reset pulse ⑤ is turned to the H level such that gray scale voltages corresponding to display data are written into the respective pixels.

The ON/OFF state of the process-result transmitting transistors (PMTT1 to PMTT3) and the voltage levels of the nodes (N1 to N7) are listed in Tables 9 and 10.

TABLE 9

| Immediately after time t6 | | | | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| ON | ON | OFF | High | High | High | High | Low | Low | High | OFF | V5 |

TABLE 10

| Immediately after time t7 | | | | | | | | | | | |
|---|---|---|---|---|---|---|---|---|---|---|---|
| PMTT1 | PMTT2 | PMTT3 | N1 | N2 | N3 | N4 | N5 | N6 | N7 | GT5 | N8 |
| ON | ON | ON | High | High | High | High | Low | Low | High | OFF | V5 |

Scanning of the horizontal shift register circuit 121 is completed during the above-explained operation such that the display data corresponding to the next horizontal scanning line (see the data of FIG. 18B) are stored into the memory capacitances (C1, C2 and C3) associated with the data lines (DD3, DD2 and DD1), respectively.

After this, the gray scale voltage shown in FIG. 17 is returned to the voltage V0, and the scanning corresponding to time t0 to time t7 is repeated again. At this time, the vertical scanning circuit 130 selects the next scanning line.

In the fourth embodiment, since the components, for example, the PMOS processing transistors (PMTG1 and PMTT1), the NMOS processing transistors (NMTG1, NMTTG1, and NMTM1), the memory capacitance (CM1), the negative power supply (Vss), and the voltage bus line 151, for each bit of the display data can be formed independently except for the nodes (N2, N3, and N4) for applying a control voltage to the gate circuit GT5, wiring between processing circuits associated with each bit is not needed.

Accordingly, the liquid crystal display module of the fourth embodiment is suitable for a small-sized liquid crystal display device which needs high density layout particularly.

For example, in a case where the selector circuit or the like is incorporated into a 0.7 inch (17.78 mm in diagonal dimension) XGA type liquid crystal display panel, the selector circuits must be arranged with a pitch (width) of about 14 $\mu$m.

For example, in a case where the display data comprises 8-bits and the wiring of 2 $\mu$m lines and 2 $\mu$m spaces is used, 32 $\mu$m is required for only the wiring from the digital signal memory array 122 to the first selector circuit 223 and the second selector circuit 224 for the circuit structure shown in FIG. 8, and this cannot be realized. On the other hand, the present embodiment can realize the above circuit structure easily.

In the present embodiment, although the case of 3-bit display data is exemplarily described, the number of bits of the display data can be increased only by adding components for each bit of the display data (for example, PMOS transistors (PMTG1 and PMTT1), NMOS transistors (NMTG1 and NMTT1), a memory capacitance (CM1), a negative power supply (Vss), and a time control signal line).

For example, in the case of 8-bit display data, the total number of required transistors are 50 for each drain signal line (D).

Furthermore in the present embodiment, it is possible to replace the p-type FETs (PMTT1, PMTT2, and PMTT3) with n-type FETs by interchanging the respective time control signal lines 161 to 169 with the wiring of the power supply line of the negative power supply potential (Vss).

However, in the present embodiment, even if the use of the PMOS transistors (PMTT1, PMTT2, and PMTT3) causes charge pumping to occur under the gate electrode of the FET due to ON/OFF of the FET while the nodes (N2, N3, and N4) are in the floating state, the potentials of the nodes (N2, N3, and N4) are decreased, that is, only the L level is made lower, such that the ON level of the gate circuit (GT5) is free from instability, and the malfunction of the gate circuit (GT5) is prevented.

On the other hand, when the nodes (N2, N3, and N4) are in the H level, the potentials of the nodes (N2, N3, and N4) is decreased, but in this case, since supplement from the higher-order bit side is performed periodically, unstable function is prevented by setting suitable values of the node capacitances. In a case where the control voltage for turning off the gate circuit (GT5) is set to be as the H level, it is advantageous in that a threshold voltage is not lowered in the circuit structure comprising p-type FETs, the voltage is transmitted to the next node, and furthermore the charging speed at the next node is fast because of its discharge mode.

For the same reason, the p-type FET PMOS (PMTIN1) is employed as an FET to which the power supply potential (VDD) is inputted.

Generally, if the same voltage (direct current voltage) is applied across a liquid crystal layer for a long period of time, then tilting of liquid crystal molecules is fixed and image retention is caused, and the service life of the liquid crystal layer is shortened.

To prevent this problem, a TFT type liquid crystal display module is configured such that the polarity of voltages applied across the liquid crystal layer is reversed periodically, that is, voltages applied to the pixel electrodes are made alternately positive and negative with respect to the common electrode voltage periodically.

A method of AC driving the TFT type liquid crystal display module used in the above-mentioned embodiments is described hereinunder. As the driving method for applying an alternating voltage across a liquid crystal layer, two methods, namely a fixed common-electrode voltage method and a common-electrode voltage inversion method, have been known.

The common-electrode voltage inversion method reverses polarities of both voltages applied to a common electrode (ITO2) and a pixel electrode (ITO1) alternately.

The fixed common-electrode voltage method makes voltages applied to the pixel electrode (ITO1) alternately positive and negative with respect to a fixed voltage applied to the common electrode (ITO2), and the fixed common-electrode voltage method is advantageous in low power consumption and display quality.

The liquid crystal display module of the present invention is applicable to both the methods by changing the polarity of the gray scale voltages supplied from the power supply 12. For example, as shown in FIG. 20, even in a case where the method of AC driving in which gray scale voltages of positive polarity are applied to odd horizontal scanning lines in odd frames and gray scale voltage of negative polarity are applied to even horizontal scanning lines in odd frames, and gray scale voltages of negative polarity are applied to odd scanning lines in even frames and gray scale voltages of positive polarity are applied to even scanning lines in even frames is employed, the liquid crystal display module of the present invention is easily applicable by supplying gray scale voltages VA1 to VA8, for example, with the polarity of the gray scale voltages reversed on alternate horizontal scanning lines from the power supply 12 to the first selector circuit 123 (refer to FIG. 1) or the selector circuit 324 (refer to FIG. 15).

Figure 20:
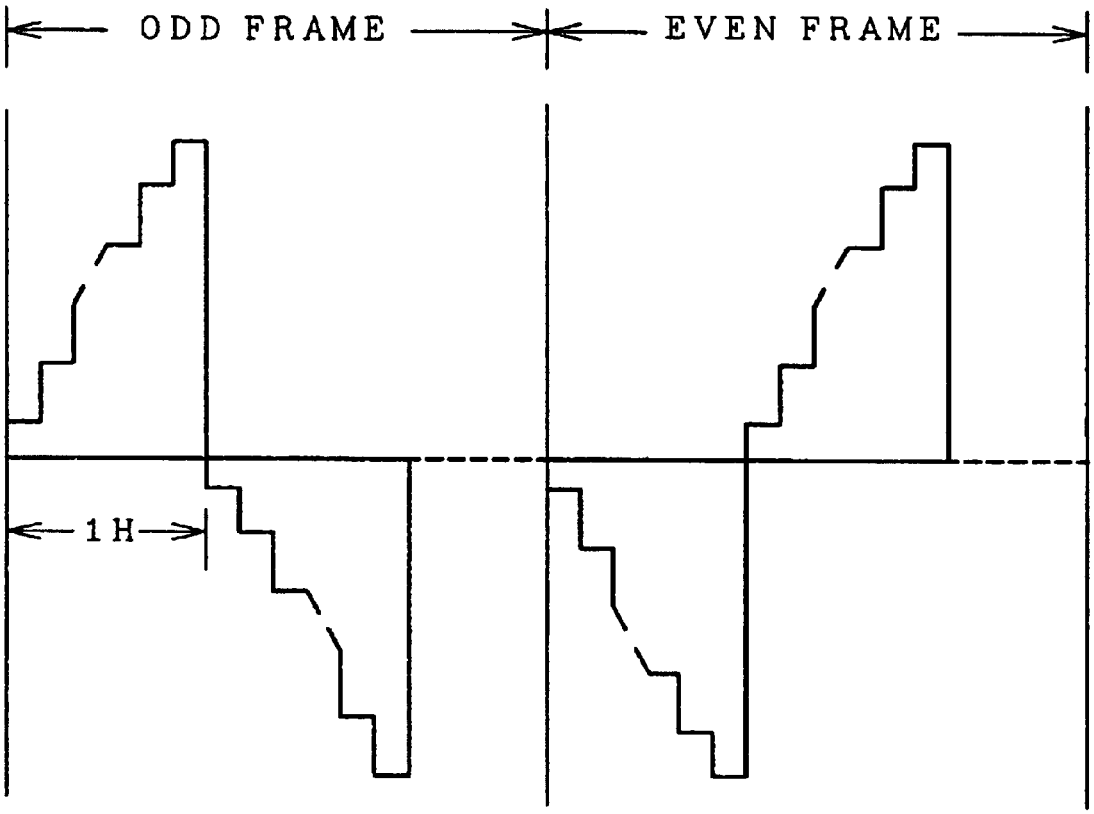
FIG. 20 is a diagram for explaining an exemplary method of AC driving in the respective embodiments of the present invention.

The dot-inversion drive method shown in FIG. 20 has been known as one of the fixed common-electrode voltage method.

Figure 21A:
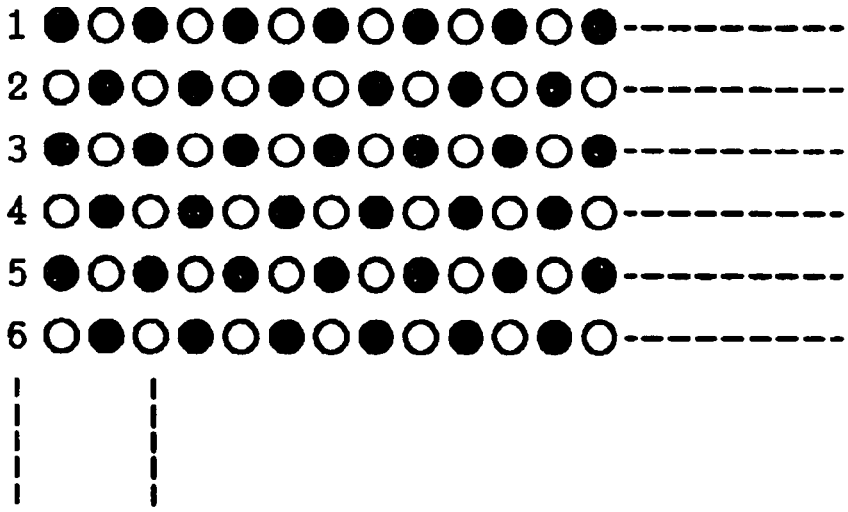

The dot-inversion drive method is shown exemplarily in FIGS. 21A and 20B.

FIG. 21A is an illustration of an example of an odd frame. Consider the odd horizontal scanning lines first. The odd drain signal lines (D) are supplied with negative-polarity gray scale voltages represented by black circles ● in FIG. 21A and the even drain signal lines (D) are supplied with positive-polarity gray scale voltages represented by white circles ○ in FIG. 21A.

Next consider the even horizontal scanning lines. The odd drain signal lines (D) are supplied with positive-polarity gray scale voltages represented by white circles ○ in FIG. 21A and the even drain signal lines (D) are supplied with negative-polarity gray scale voltages represented by black circles ● in FIG. 21A.

Further, the polarity of the voltage on each horizontal scanning line is reversed on alternate frames.

Figure 21B:
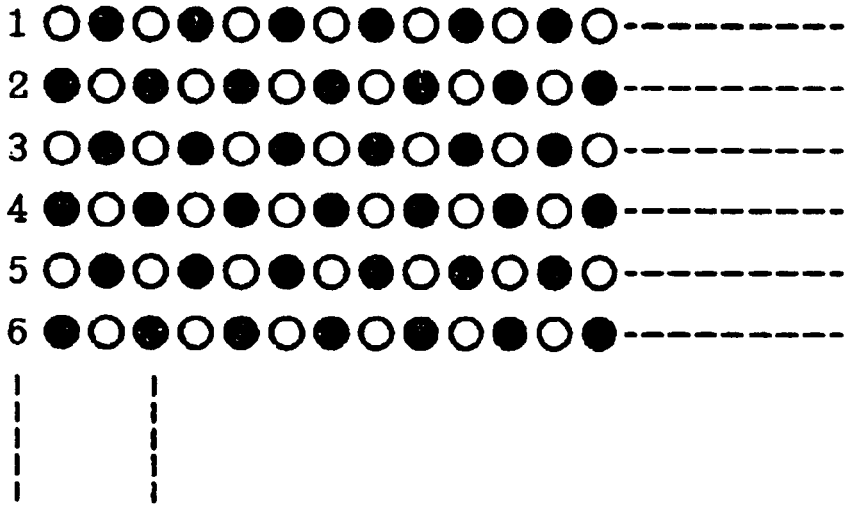

FIG. 21B is an illustration of an example of an even frame. Consider the odd horizontal scanning lines first. The odd drain signal lines (D) are supplied with positive-polarity gray scale voltages represented by white circles ○ in FIG. 21B and the even drain signal lines (D) are supplied with negative-polarity gray scale voltages represented by black circles ● in FIG. 21B. Next consider the even horizontal scanning lines. The odd drain signal lines (D) are supplied with negative-polarity gray scale voltages represented by black circles ● in FIG. 21B and the even drain signal lines (D) are supplied with positive-polarity gray scale voltages represented by white circles ○ in FIG. 21B.

By use of the dot-inversion drive method, the polarities of the voltages applied to two adjacent drain signal lines (D) are reverse from each other and consequently the currents flowing into the common electrode (ITO2) or the gate electrodes of the thin film transistors (TFT) adjacent to each other cancel out each other, and the power consumption is reduced.

Since a current which flows to the common electrode (ITO2) is small and the voltage drop is not large, the voltage level of the common electrode (ITO2) is maintained stable and the deterioration of the display quality is minimized.

Figure 22:
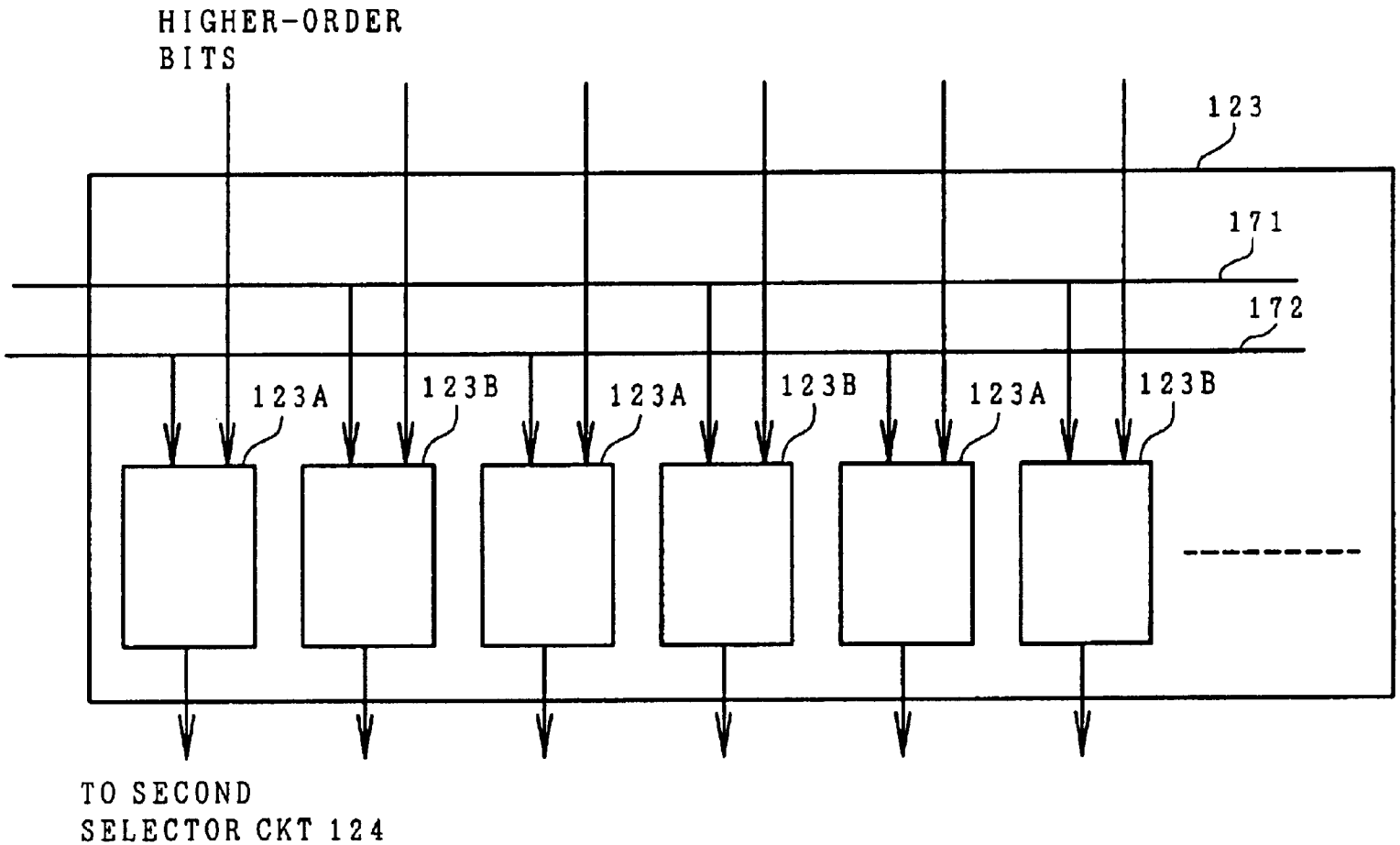
FIG. 22 is a block diagram for illustrating a circuit structure for employing a dot-inversion drive method in the respective embodiments of the present invention.

A case in which the dot-inversion drive method is employed in the liquid crystal display module in accordance with the previous embodiments 1 to 3 will be explained by reference to FIG. 22. In FIG. 22, two bus lines 171 and 172 are provided. One bus line 171 of the two bus lines supplies gray scale voltages to odd ones (denoted by reference numeral 123A in FIG. 22) of selectors associated with respective drain signal lines (D) in the first selector circuit 123, the other bus line 172 supplies gray scale voltages to even ones (denoted by reference numeral 123B in FIG. 22) of the selectors, and gray scale voltages supplied to the respective bus lines from the power supply 12 are reversed on alternate horizontal scanning lines with the polarities of the two gray scale voltage being opposite from each other.

In the case of the liquid crystal display module in accordance with the previous embodiment 4, as in the above case, two bus lines 171 and 172 are provided. One bus line of the two bus lines supplies gray scale voltages to the odd ones of selectors associated with respective drain signal lines (D) in the selector circuit 322, the other bus line supplies gray scale voltages to the even ones of the selectors, and gray scale voltages supplied to the respective bus lines from the power supply 12 are reversed on alternate horizontal scanning lines with the polarities of the two gray scale voltage being opposite from each other.

In the above-mentioned embodiments, although the embodiments in which the horizontal scanning circuit 120 and the vertical scanning circuit 130 are incorporated into the liquid crystal display panel are described, the present invention is by no means limited to these embodiments, and the horizontal scanning circuit 120 and the vertical scanning circuit 130 may be provided externally of the liquid crystal display panel.

Although the detail of the present invention accomplished by the inventors of the present invention is described based on the above-mentioned embodiments hereinbefore, the present invention is by no means limited to the above-mentioned embodiments of the present invention, it is apparent for a person skilled in the art that various modifications may be applied without departing from the scope and the spirit of the present invention.

The representative advantages of the present invention are summarized as below.

(1) According to the present invention, the number of signal lines in the horizontal scanning driving means and the total number of transistors can be reduced, and the circuit scale of the horizontal scanning driving means can be reduced.

(2) According to the present invention, the area occupied by the horizontal driving means incorporated into a liquid crystal display element is reduced.

(3) According to the present invention, the size of a liquid crystal display element is reduced.

What is claimed is:

1. A liquid crystal display device comprising:

a plurality of pixels arranged in a matrix;

a plurality of video signal lines for supplying video signal voltages to said plurality of pixels; and a drive circuit for selecting a voltage level of a gray scale voltage varying periodically, as one of said video signal voltages corresponding to display data to be supplied to one of said plurality of pixels;

wherein said drive circuit has a plurality of series combinations of plural processing circuits;

each of said plurality of series combinations of plural processing circuits corresponding to one of said plurality of video signal lines;

each of said plural processing circuits includes a switching element which is activated by said display data; and a respective one of said plurality of series combinations of said plural processing circuits determines a time to select said voltage level by a combination of statuses of said switching elements in said respective one of said plurality of series combinations of plural processing circuits.

2. A liquid crystal display device according to claim 1, wherein said gray scale voltage varies in a staircase fashion during a horizontal scanning period.

3. A liquid crystal display device according to claim 1, wherein each of said plurality of series combinations of plural processing circuits is disposed along an extension line of a corresponding one of said plurality of video signal lines.

4. A liquid crystal display device according to claim 1, wherein each of said switching elements is activated by a combination of a time control signal and said display data.

5. A liquid crystal display device comprising:

a plurality of pixels arranged in a matrix;

a plurality of video signal lines for supplying video signal voltages to said plurality of pixels; and a drive circuit for selecting one voltage level of a gray scale voltage varying with a horizontal scanning period, as one of said video signal voltages according to display data for one of said plurality of pixels;

wherein said drive circuit has a plurality of series combinations of plural processing circuits for performing a logic operation in order to select said one voltage level of said gray scale voltage;

each of said plurality of series combinations of plural processing circuits corresponding to one of said plurality of video signal lines;

each of said plural processing circuits in a respective one of said plurality of series combinations of plural processing circuits is supplied with said display data; and each of said plurality of series combinations of plural processing circuits is configured such that a respective one of said processing circuits transmits a processing result based upon said display data to one of said processing circuits succeeding said respective one.

6. A liquid crystal display device according to claim 5, wherein said gray scale voltage varies in a staircase fashion.

7. A liquid crystal display device according to claim 5, wherein each of said plurality of series combinations of plural processing circuits is disposed along an extension line of a corresponding one of said plurality of video signal lines.

8. A liquid crystal display device according to claim 5, further comprising time control signal lines for supplying time control signals varying in synchronism with said gray scale voltage to said driving circuit.

9. A liquid crystal display device comprising:

a plurality of pixels arranged in a matrix;

a plurality of video signal lines for supplying video signal voltages to said pixels respectively; and a drive circuit for selecting a voltage level of grayscale voltages varying periodically as one of said video signal voltages corresponding to display data to be supplied to one of said pixels;

wherein said drive circuit has a plurality of processing circuits being connected to each other in series for determining a time to select said voltage level, each of said processing circuits including a switching element which is activated by said display data so that said processing circuits determine said time by a combination of status of said switching element in each of said processing circuits.

10. A liquid crystal display device according to claim 9, wherein said grayscale voltage varies in a staircase fashion during a horizontal scanning period.

11. A liquid crystal display device according to claim 9, wherein said processing circuits are disposed along an extension line of the respective one of said plurality of video signal lines.

12. A liquid crystal display device according to claim 9, wherein said switching element is activated by a time control signal in addition to said display data.

13. A liquid crystal display device comprising:

a plurality of pixels arranged in a matrix;

a plurality of video signal lines for supplying video signal voltages to said plurality of pixels respectively;

a drive circuit selecting one of grayscale voltages varying with a horizontal scanning period as one of said video signal voltages according to display data for one of said pixels;

wherein said drive circuit has a plurality of processing circuits for performing logic operation in order to select said one of said grayscale voltages, each of said processing circuits connecting in series so that one of said processing circuits transmits a processing result to the next one of processing circuits.

14. A liquid crystal display device according to claim 13, wherein said grayscale voltage varies in a staircase fashion.

15. A liquid crystal display device according to claim 13, wherein said processing circuits are disposed along an extension line of one of said plurality of video signal lines.

16. A liquid crystal display device according to claim 13, further comprising time control signal lines for supplying time control signals varying in synchronism with said grayscale voltage to said driving circuit.

* * * * *

UNITED STATES PATENT AND TRADEMARK OFFICE

CERTIFICATE OF CORRECTION

PATENT NO. : 6,914,592 B2
APPLICATION NO. : 10/192695
DATED : July 5, 2005
INVENTOR(S) : Miyazawa et al It is certified that error appears in the above-identified patent and that said Letters Patent is hereby corrected as shown below:

Title Page:

(63) Related U.S. Application Data

Continuation of application No 09/421,009, filed Oct. 20, 1999, now Pat. No. 6,433,768

Column 1, paragraph beginning on line 7 to read:

This is a continuation of U.S. application Ser. No. 09/421, 009, filed Oct. 20, 1999, now U.S. Pat. No. 6,433,768, the subject matter of which is incorporated by reference herein.

Signed and Sealed this

First Day of August, 2006

JON W. DUDAS
*Director of the United States Patent and Trademark Office*